US005151344A

United States Patent [19]

Abe et al.

[11] Patent Number: 5,151,344

[45] Date of Patent: Sep. 29, 1992

[54] METHOD FOR PROCESSING A SILVER HALIDE COLOR PHOTOGRAPHIC MATERIAL

[75] Inventors: Akira Abe; Keiji Mihayashi; Seiji Ichijima, all of Kanagawa, Japan

[73] Assignee: Fuji Photo Film Co., Ltd., Kanagawa, Japan

[21] Appl. No.: 774,741

[22] Filed: Oct. 10, 1991

Related U.S. Application Data

[63] Continuation of Ser. No. 444,445, Nov. 22, 1989, abandoned, which is a continuation-in-part of Ser. No. 199,826, May 27, 1988, abandoned.

[30] Foreign Application Priority Data

May 28, 1987 [JP] Japan ..... 62-133018

[51] Int. Cl.[5] ..... G03C 7/30

[52] U.S. Cl. ..... 430/383; 430/376; 430/382; 430/435; 430/505; 430/543; 430/544; 430/549; 430/957

[58] Field of Search ..... 430/376, 382, 383, 435, 430/505, 543, 544, 549, 957

[56] References Cited

U.S. PATENT DOCUMENTS

| | | | |
|---|---|---|---|
| 4,297,437 | 10/1981 | Kaneko et al. | 430/399 |
| 4,618,571 | 10/1986 | Ichijima et al. | 430/505 |
| 4,791,049 | 12/1988 | Kojima et al. | 430/544 |
| 4,797,351 | 1/1989 | Ishikawa et al. | 430/399 |
| 4,818,664 | 4/1989 | Ueda et al. | 430/957 |
| 4,873,179 | 10/1989 | Abe et al. | 430/376 |

*Primary Examiner*—Hoa Van Le

*Attorney, Agent, or Firm*—Sughrue, Mion, Zinn, Macpeak & Seas

[57] ABSTRACT

A method for processing a silver halide color photographic material is described, comprising a support having thereon at least one of a light-sensitive silver halide emulsion layer and an adjacent layer thereof containing, at least one compound represented by the formula (V), wherein said silver halide color photographic material is subjected to a color-developing-process with a color developing solution which a replenisher is replenished in an amount of 700 ml or less per $m^2$ of the silver halide color photographic material:

(V)

wherein A represents a coupler residue; $R_{11}$ represents a divalent aliphatic group having from 1 to 4 carbon atoms; and $R_{12}$ and $R_{13}$ each represents an aliphatic group having from 1 to 4 carbon atoms.

According to the method of processing a silver halide color photographic material, processing performance does not change in spite of the reduced replenishing amount of color developing solution.

The method of the present invention is particularly effective with silver halide color photographic materials for photographing.

8 Claims, No Drawings

METHOD FOR PROCESSING A SILVER HALIDE COLOR PHOTOGRAPHIC MATERIAL

This is a continuation of application Ser. No. 07/444,445, filed Nov. 22, 1989, now abandoned, which is a continuation-in-part of application Ser. No. 07/199,826, filed May 27, 1988, now abandoned.

FIELD OF THE INVENTION

The present invention relates to a method for processing a silver halide color photographic material, and more particularly to an improved method for processing a silver halide color photographic material for photographing wherein processing performance does not change even with a change in the amount of replenishment of a color developing solution.

BACKGROUND OF THE INVENTION

In recent years, various investigations on techniques for reducing the amount of waste in processing of color photographic matrials have been made by necessity in order to reduce water pollution and to reduce processing costs. Such techniques are practically employed in certain processing steps. In particular, with respect to the color developing step, various kinds of methods have been hitherto proposed since a great burdon has been imposed to prevent environmental pollution caused by waste. For example, methods for regeneration of color developing solutions utilizing electrodialysis as described in Japanese Patent Application (OPI) Nos. 37731/79, 1048/81, 1049/81, 27142/81, 33644/81 and 149036/81 (the term "OPI" as used herein refers to a "published unexamined Japanese patent application") and Japanese Patent Publication No. 10199/86 are known. Further, various methods for regeneration of color developing solutions using active carbon as descried in Japanese Patent Publication No. 1571/80 and Japanese Patent Application (OPI) No. 14831/83, using an ion exchange membrane as described in Japanese Patent Application (OPI) No. 105820/77, or using an ion exchange resin as described in Japanese Patent Application (OPI) Nos. 144240/80, 146249/82 and 95352/86 are proposed.

However, these methods require a high level of control and a costly device in order to necessarily analize the color developing solution and regulate its composition. Consequently, these methods are practiced only in some large scale laboratories.

On the other hand, a processing method with low replenishment is also utilized wherein the amount of replenishment is reduced by regulating the composition of a replenisher for the color developing solution (hereinafter referred to as a color developing replenisher) without using the regeneration described above. In order to regulate the composition of a replenisher in a processing method with low replenishment, a means for concentration of consumed components, for example, a color developing agent and a preservative, etc. is employed for the purpose of supplying the necessary amount of the components even when the amount of replenisher is reduced. Further, when silver halide color photographic materials are treated, halogen ions are released in the color developing solution. In the processing method with low replenishment, the bromide ion concentration in particular increases in the color developing solution, and as a result, development is restrained. Therefore, in order to prevent the restraint of development, a means of reducing the bromide concentration in the replenisher as compared with conventional replenishment methods is generally employed.

The processing method with low replenishment described above is advantageous since it can be practiced without analysis of the composition of the solution in all particulars in the case of processing a certain large amount of photographic light-sensitive materials every day and of conducting the processing with a small range of reduction in the amount of replenisher.

However, when the amount of photographic light-sensitive materials to be processed (hereinafter simply referred to as a processing amount) is small or when the range of reduction in the amount of replenisher is large, the retention time of the solution in the processing tank is increased as a result of the reduction in the amount of replenisher. The long retention time causes changes in the composition of the developing solution due to evaporation of water and oxidation of the preservative and the developing agent and results in an undesirable severe change in processing performance.

The amount of replenisher for a color developing solution can be varied depending on the kind of photographic light-sensitive materials. For instance, in the case of a color negative film for photographing, the amount of replenisher is ordinarily about 1200 ml per $m^2$ of the film. When the amount of replenisher is reduced to a range of 600 ml per $m^2$ or less, the above described problem becomes notable. Compensation for the change may be possible to a certain degree if the processing amount is constant every day. However, it is well known in this field that the processing amount varies over a wide range depending on the day, month and season. Therefore, it is very difficult to maintain the desirable solution composition in the processing method with exceptionally low replenishment and the processing method results in a remarkable variation of gradation and fog density in the photographic material processed.

Accordingly, although the above described processing method with low replenishment is advantageous in view of simplicity, it can be practically employed only under a restricted processing condition. Further, the excessive reduction of the amount of replenisher cannot be actually effected.

SUMMARY OF THE INVENTION

Therefore, an object of the present invention is to provide a method for processing a silver halide color photographic material which enables excessive reduction of the replenishment amount and the maintenance of stable performance even when the processing amount is small or varies over a wide range.

Another object of the present invention is to promote the spread of development processing with reduced environmental pollution in a wide area.

A further object of the present invention is to provide a low-priced method for processing covering a wide area.

Other objects of the present invention will become apparent from the following description and examples.

These objects of the present invention can be accomplished with a method for processing a silver halide color photographic material comprising a support having thereon at least one of a light-sensitive silver halide emulsion layer and an adjacent layer thereof containing at least one compound represented by the formula (I), wherein said silver halide color photographic material is subjected to a color-developing-process with a color developing solution which a replenisher is replenished in an amount of 700 ml or less per $m^2$ of the silver halide color photographic material:

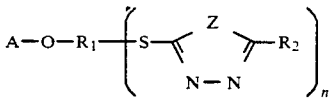

(I)

wherein A represents a coupler residue; $R_1$ represents an aromatic group having a hydroxy group at a 2-position or 4-position counted from the position at which the aromatic group is connected to the oxygen atom; Z represents a sulfur atom or an oxygen atom; $R_2$ represents a substituent; and n represents 1 or 2.

DETAILED DESCRIPTION OF THE INVENTION

The compound represented by the formula (I) will be described in greater detail below.

In the formula (I), the coupler residue represented by A which can be utilized includes any known coupler residue. Suitable examples of the coupler residue include a yellow coupler residue (for example, an open-chain ketomethylene type coupler residue, etc.), a magenta coupler residue (for example, a 5-pyrazolone type coupler residue, a pyrazoloimidazole type coupler residue, a pyrazolotriazole type coupler residue, etc.), a cyan coupler residue (for example, a phenol type coupler residue, a naphthol type coupler residue, etc.), and a non-color forming coupler residue (for example, an indanone type coupler residue, an acetophenone type coupler residue, etc.), etc. Further, the coupler residues as described in U.S. Pat. Nos. 4,315,070, 4,183,752, 4,171,223 and 4,226,934, etc. are also useful.

The group represented by $R_1$ in the formula (I) is preferably a benzene ring which may have one or more substituents in addition to the hydroxy groups at the 2-position or 4-position counted from the position at which the atomic group is connected to the oxygen atom. Preferred examples of the substituent include a group of $R_3$—, a group of $R_3OCO$—, a group of

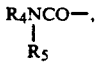

a group of $R_3SO_2$—, a group of

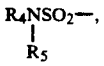

a group of N≡C—, a halogen atom, a group of $R_4CO$—, a group of $R_4O$—, a group of

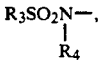

a group of

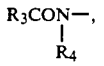

a group of $R_4S$—, a group of

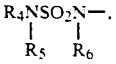

a group of

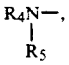

a group of

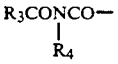

and a group of

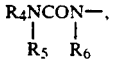

wherein $R_3$ represents an aliphatic group, an aromatic group or a heterocyclic group; and $R_4$, $R_5$ and $R_6$ each represents an aliphatic group, an aromatic group, a heterocyclic group or a hydrogen atom.

Of the substituents described above for $R_1$, a group of $R_3OCO$—, a group of

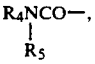

a group of $R_4O$—, a group of $R_3$—, a halogen atom and a group of $R_4S$— are particularly preferred.

The aliphatic group described above is an aliphatic hydrocarbon group having from 1 to 20 carbon atoms and preferably from 1 to 10 carbon atoms and may be saturated or unsaturated, a straight chain, branched chain or cyclic, or substituted or unsubstituted. Representative examples of the aliphatic group include a methyl group, an ethyl group, a propyl group, an isopropyl group, a butyl group, a tert-butyl group, an isobutyl group, a tert-amyl group, or a cyclohexyl group, etc.

The aromatic group described above is an aromatic group having from 6 to 20 carbon atoms, and preferably a substituted or unsubstituted phenyl group or a substituted or unsubstituted naphthyl group.

The heterocyclic group described above is a heterocyclic group having from 1 to 20 carbon atoms and preferably from 1 to 7 carbon atoms and containing at least one of a nitrogen atom, an oxygen atom and a sulfur atom, as a hetero atom, and is preferably a 3-membered to 8-membered, substituted or unsubstituted heterocyclic group. Representative examples of the substituted or unsubstituted heterocyclic group include a 2-pyridyl group, a 2-thienyl group, a 2-furyl group, a 2-imidazolyl group, a pyrrolidino group, a 2-pyrimidinyl group, a 1-imidazolyl group, a succinimido group, a phthalimido group, a 1,3,4-thiadiazol-2-yl group, or triazolyl group, etc.

The aliphatic group, aromatic group or heterocyclic group, as described above may have one or more substituents. Representative examples of the substituents include an aliphatic oxy group, an aliphatic thio group, an aliphatic carbonyloxy group, an aromatic carbonyloxy group, a halogen atom, a cyano group, an aliphatic oxycarbonyl group, an aromatic oxycarbonyl group and a heterocyclic group, etc. The aliphatic group, aromatic group and heterocyclic group each has the same meaning as defined above.

Specific examples of the group represented by $R_1$ are set forth below. In the following formulae, a bond indicated by * denotes the position at which the group is connected to the oxygen atom, and a bond indicated by ** denotes the position at which the group is connected to the sulfur atom in the formula (I).

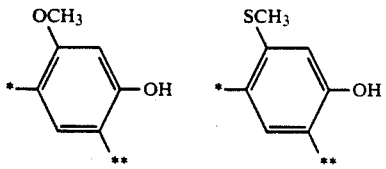

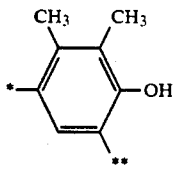
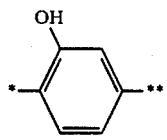
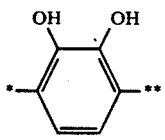
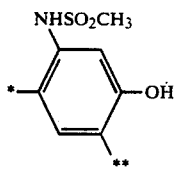
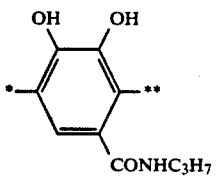
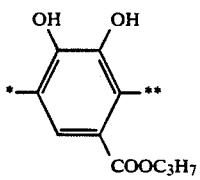
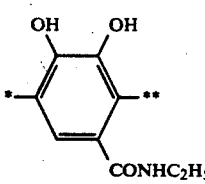
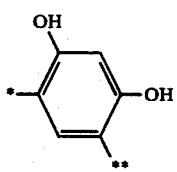
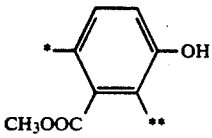
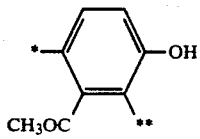
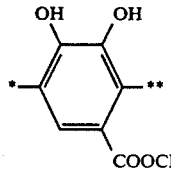
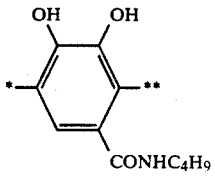

-continued

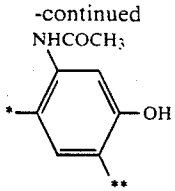
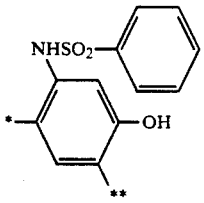
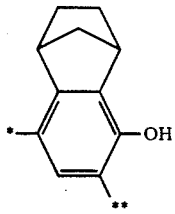
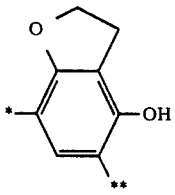
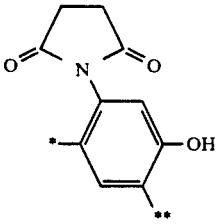
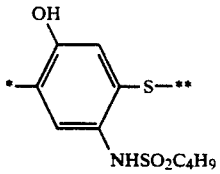
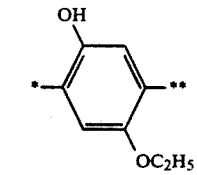
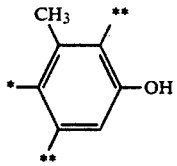
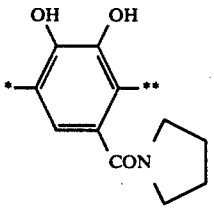
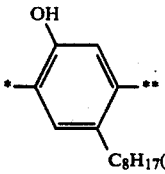
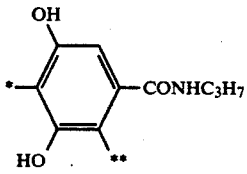
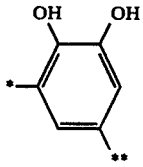
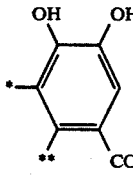
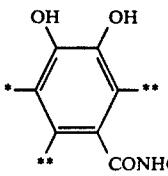
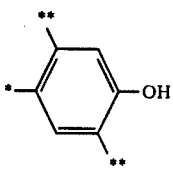

-continued

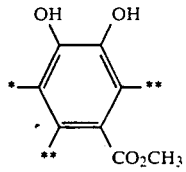

In the formula (I), $R_2$ represents a substituent. Representative examples of the substituents include a group of $R_7$—, a group of $R_8S$—, a group of $$R_7CON(R_8)-,$$

a group of $$R_7OCON(R_8)-,$$

a group of $$R_7SO_2N(R_8)-,$$

a group of $$R_8N(R_9)-,$$

a group of $R_7O$—, a group of $$R_8NCON(R_9)(R_{10})-$$

and a group of $R_7COS$—, wherein $R_7$ represents an aliphatic group, an aromatic group or a heterocyclic group; and $R_8$, $R_9$ and $R_{10}$ each represents an aliphatic group, an aromatic group, a heterocyclic group or a hydrogen atom. The aliphatic group, aromatic group and heterocyclic group each has the same meaning as defined above for $R_1$.

Of the substituents described above for $R_2$, a group of $R_8S$— and a group of $$R_7CON(R_8)-$$

are particularly preferred.

Specific examples of the group represented by $R_2$ are set forth below. In the following formulae, a bond indicated by * denotes the position at which the group is connected in the formula (I).

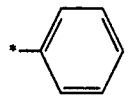

*—$CH_3$ *—$C_2H_5$ *—S—$CH_3$ *—$SC_2H_5$

*—$SC_3H_7$ *—$SC_3H_7$(i) *—$SC_4H_9$ *—$SC_4H_9$(i) *—$SC_4H_9$(s)

-continued

*—$SCH_2CO_2CH_3$ *—$SCH_2CH_2CO_2CH_3$ *—$SCH(CH_3)CO_2CH_3$

*—$SCH_2CO_2C_2H_5$ *—$SCH_2CH_2CO_2C_2H_5$ *—$SCH(C_2H_5)CO_2CH_3$

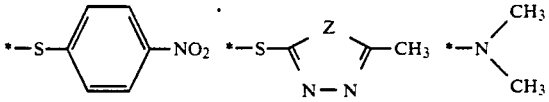

*—$NHCOCH_3$ *—$NHCOC_3H_7$ *—$NHCOCH_2OCH_3$

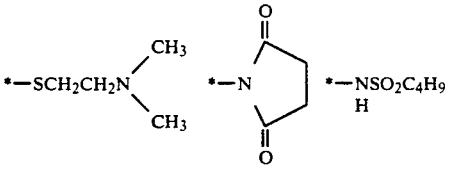

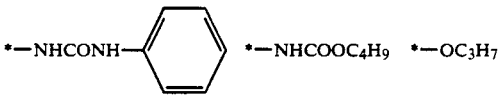

*—$NHCOOC_4H_9$ *—$OC_3H_7$

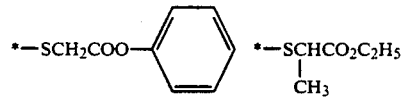

*—$SCH_2CH_2OCH_3$ *—$SCH_2CH_2SC_2H_5$

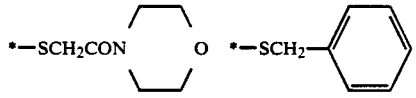

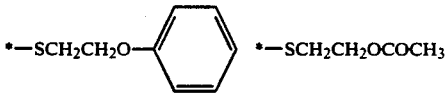

*—$SCH_2CH_2OCOCH_3$

Of the compounds represented by the formula (I) used in the present invention, those particularly preferred are represented by the formula (II):

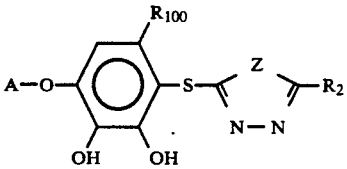

(II)

wherein A has the same meaning as defined for formula (I), Z represents a sulfur atom or an oxygen atom; $R_2$ has the same meaning as defined for formula (I) and thus is a substituent, the substituent being any of the substituents described for $R_2$ in formula (I); $R_{100}$ is selected from the group consisting of $$R_3-,\ R_3OCO-,\ R_4N(R_5)CO-,\ R_3SO_2-,\ R_4N(R_5)SO_2-,\ N\equiv C-,$$

-continued a halogen atom, $R_4CO-$, $R_4O-$, $R_3SO_2N(R_4)-$, $R_3CON(R_4)-$, $R_4S-$, $R_4NSO_2N(R_5)(R_6)-$, $R_4N(R_5)-$, $R_3CONCO(R_4)-$ and $R_4NCON(R_5)(R_6)-$, wherein $R_3$ represents an aliphatic group, an aromatic group or a heterocyclic group; and $R_4$, $R_5$ and $R_6$ each represents an aliphatic group, an aromatic group, a heterocyclic group or hydrogen atom. $R_3$, $R_4$, $R_5$ and $R_6$ of formula (II) are the same as defined above in formula (I).

Of the compounds represented by formula (II), those which are especially preferred are represented by the formula (V):

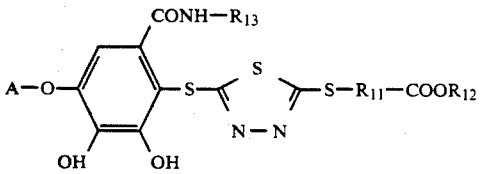

(V)

wherein A has the same meaning as defined for the formula (I); $R_{11}$ represents a divalent aliphatic group having from 1 to 4 carbon atoms; and $R_{12}$ and $R_{13}$ each represents an aliphatic group having from 1 to 4 carbon atoms.

Of the coupler residues represented by A in the formula (I), (II) and (V) preferred coupler residues include those represented by the formula (Cp-1), (Cp-2), (Cp-3), (Cp-4), (Cp-5), (Cp-6), (Cp-7), (Cp-8), (Cp-9) or (Cp-10) described below. These coupler residues are preferred because these coupler residues have high coupling rates.

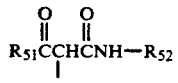

(Cp-1)

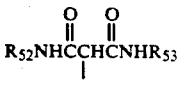

(Cp-2)

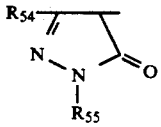

(Cp-3)

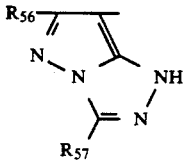

(Cp-4)

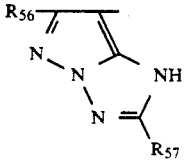

(Cp-5)

-continued

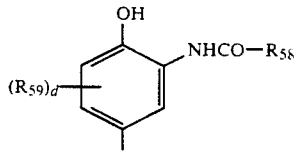

(Cp-6)

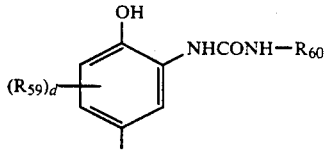

(Cp-7)

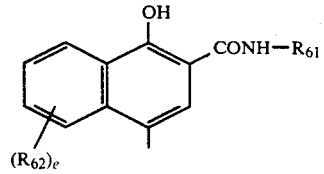

(Cp-8)

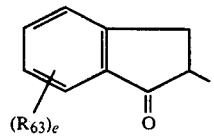

(Cp-9)

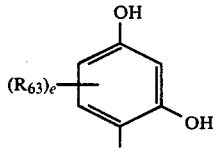

(Cp-10)

In the above-described formulae, a free bond attached to the coupling position indicates a position to which a group capable of being released upon coupling is bonded.

When $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{63}$ or $R_{63}$ in the above-described formulae contains a diffusion-resistant group, it is selected so that the total number of carbon atoms included therein is from 8 to 40 and preferably from 10 to 30. In other cases, the total number of carbon atoms included therein is preferably not more than 15. In cases of bis type, telomer type or polymer type couplers, any of the above-described substituents forms a divalent group and may connect to a repeating unit, etc. In such cases, the total number of carbon atoms may be outside of the above-described range.

Now, $R_{51}$ to $R_{63}$, d and e in the above-described formulae (CP-1) to (CP-10) are explained in detail. In the following, $R_{41}$ represents an aliphatic group, an aromatic group or a heterocyclic group; $R_{42}$ represents an aromatic group or a heterocyclic group; and $R_{43}$, $R_{44}$ and $R_{45}$ each represents a hydrogen atom, an aliphatic group, an aromatic group or a heterocyclic group.

$R_{51}$ represents the same group as defined for $R_{41}$.

$R_{52}$ and $R_{53}$ each represents the same group as defined for $R_{42}$.

$R_{54}$ represents the same group as defined for $R_{41}$, a group of $R_{41}CON(R_{43})-$, a group of $R_{41}N(R_{43})-$, a group of $R_{41}SO_2N(R_{43})-$, a group of $R_{41}S-$, a group of $R_{41}O-$, a group of $R_{45}NCON(R_{43})(R_{44})-$, a group of $R_{41}OOC-$, a group of $R_{44}NCO(R_{43})-$ or a group of $N\equiv C-$.

$R_{55}$ represents the same group as defined for $R_{41}$.

$R_{56}$ and $R_{57}$ each represents the same group as defined for $R_{43}$ a group of $R_{41}S$-, a group of $R_{41}O$-, a group of $R_{41}CON(R_{43})-$, a group of $R_{41}N(R_{43})-$, a group of $R_{43}NCON(R_{44})(R_{45})-$ or a group of $R_{41}SO_2N(R_{43})-$.

$R_{58}$ represents the same group as defined for $R_{41}$.

$R_{59}$ represents the same group as defined for $R_{41}$, a group of $R_{41}CON(R_{43})-$, a group of $R_{41}OCON(R_{43})-$, a group of $R_{41}SO_2N(R_{43})-$, a group of $R_{43}NCON(R_{44})(R_{45})-$, a group of $R_{43}NSO_2N(R_{44})(R_{45})-$, a group of $R_{41}O-$, a group of $R_{41}S-$, a halogen atom or a group of $R_{41}N(R_{43})-$.

d represents an integer of from 0 to 3. When d represents 2 or more, two or more $R_{59}$'s may be the same or different. Further, each of two $R_{59}$'s may be a divalent group and connected with each other to form a cyclic structure.

Examples of the divalent groups for forming a cyclic structure include a group of

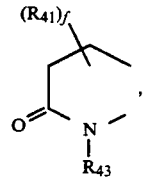

a group of

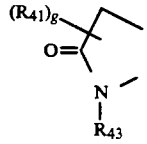

or a group of

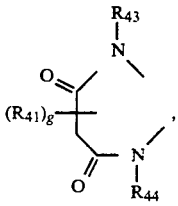

wherein f represents an integer of from 0 to 4; and g represents an integer of from 0 to 2.

$R_{60}$ represents the same group as defined for $R_{41}$.

$R_{61}$ represents the same group as defined for $R_{41}$.

$R_{62}$ represents the same group as defined for $R_{41}$, a group of $R_{41}CONH$—, a group of $R_{41}O$-CONH—, a group of $R_{41}SO_2NH$—, a group of $$R_{43}\underset{\underset{R_{44}}{|}}{N}C\underset{\underset{R_{45}}{|}}{O}N-,$$

a group of $$R_{43}\underset{\underset{R_{44}}{|}}{N}S\underset{\underset{R_{45}}{|}}{O_2}N-,$$

a group of $R_{43}O$—, a group of $R_{41}S$—, a halogen atom or a group of $$R_{41}\underset{\underset{R_{43}}{|}}{N}-.$$

$R_{63}$ represents a group defined for $R_{41}$, a group of $$R_{43}C\underset{\underset{R_{44}}{|}}{O}N-,$$

a group of $$R_{43}\underset{\underset{R_{44}}{|}}{N}CO-,$$

a group of $$R_{41}SO_2\underset{\underset{R_{44}}{|}}{N}-,$$

a group of $$R_{43}\underset{\underset{R_{44}}{|}}{N}SO_2-,$$

a group of $R_{41}SO_2$—, a group of $R_{43}OCO$—, a group of $R_{43}OSO_2$—, a halogen atom, a nitro group, a cyano group or a group of $R_{43}CO$—.

e represents an integer of from 0 to 4. When e represents 2 or more, two or more $R_{62}$'s or $R_{63}$'s may be the same or different.

The aliphatic group described above is an aliphatic hydrocarbon group having from 1 to 32 carbon atoms and preferably from 1 to 22 carbon atoms and may be saturated or unsaturated, a straight-chain, branched chain or cyclic, or substituted or unsubstituted. Representative examples of the aliphatic group include a methyl group, an ethyl group, a propyl group, an isopropyl group, a butyl group, a tert-butyl group, an isobutyl group, a tert-amyl group, a hexyl group, a cyclohexyl group, a 2-ethylhexyl group, an octyl group, a 1,1,3,3-tetramethylbutyl group, a decyl group, a dodecyl group, a hexadecyl group, or an octadecyl group, etc.

The aromatic group described above is an aromatic group having from 6 to 20 carbon atoms, and preferably an unsubstituted or substituted phenyl group or an unsubstituted or substituted naphthyl group.

The heterocyclic group described above is a heterocyclic group having from 1 to 20 carbon atoms and preferably from 1 to 7 carbon atoms and containing at least one of a nitrogen atom, an oxygen atom and a sulfur atom, as a hetero atom, and preferably is a 3-membered to 8-membered, substituted or unsubstituted heterocyclic group. Representative examples of the unsubstituted or substituted heterocyclic group inculde a 2-pyridyl group, a 4-pyridyl group, a 2-thienyl group, a 2-furyl group, a 2-imidazolyl group, a pyrazinyl group, a 2-pyrimidinyl group, a 1-imidazolyl group, a 1-indolyl group, a phthalimido group, a 1,3,4-thiadiazol-2-yl group, a benzoxazol-2-yl group, a 2-quinolyl group, a 2,4-dioxo-1,3-imidazolidin-5-yl group, a 2,4-dioxo-1,3-imidazolidin-3-yl group, a succinimido group, a phthalimido group, a 1,2,4-triazol-2-yl group, or a 1-pyrazolyl group, etc.

The aliphatic group, aromatic group and heterocyclic group may have one or more substituents as described above. Representative examples of the substituents include a halogen atom, a group of $R_{47}O$—, a group of $R_{46}S$—, a group of $$R_{47}C\underset{\underset{R_{48}}{|}}{O}N-,$$

a group of $$R_{47}\underset{\underset{R_{48}}{|}}{N}CO-,$$

a group of $$R_{46}O\underset{\underset{R_{47}}{|}}{C}ON-,$$

a group of $$R_{46}SO_2\underset{\underset{R_{47}}{|}}{N}-,$$

a group of $$R_{47}\underset{\underset{R_{48}}{|}}{N}SO_2-,$$

a group of $R_{46}SO_2$—, a group of $R_{47}OCO$—, a group of $$R_{47}\underset{\underset{R_{48}}{|}}{N}C\underset{\underset{R_{49}}{|}}{O}N-,$$

a group defined for $R_{46}$, a group of

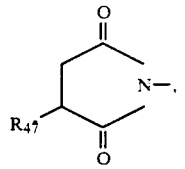

a group of $R_{46}COO$—, a group of $R_{47}OSO_2$—, a cyano group, or a nitro group, etc. In the above described formulae, $R_{46}$ represents an aliphatic group, an aromatic group or a heterocyclic group; and $R_{47}$, $R_{48}$ and $R_{49}$ each represents a hydrogen atom, an aliphatic group, an aromatic group or a heterocyclic group. The aliphatic group, aromatic group and heterocyclic group each has the same meaning as defined above for $R_{41}$ to $R_{45}$.

Preferred examples of $R_{51}$ to $R_{63}$, d and e are described below.

$R_{51}$ is preferably an aliphatic group or an aromatic group.

$R_{52}$, $R_{53}$ and $R_{55}$ each is preferably an aromatic group.

$R_{54}$ is preferably a group of $R_{41}CONH$— or a group of $$R_{41}\underset{\underset{R_{43}}{|}}{N}-.$$

$R_{56}$ and $R_{57}$ each is preferably an aliphatic group, a group of $R_{41}O$— or a group of $R_{41}S$—.

$R_{58}$ is preferably an aliphatic group or an aromatic group.

$R_{59}$ in the formula (Cp-6) is preferably a chlorine atom, an aliphatic group or a group of $R_{41}CONH$—.

d in the formula (CP-6) is preferably 1 or 2.

$R_{60}$ is preferably an aromatic group.

$R_{59}$ in the formula (Cp-7) is preferably a group of $R_{41}CONH$—.

d in the formula (Cp-7) is preferably 1.

$R_{61}$ is preferably an aliphatic group or an aromatic group.

e in the formula (Cp-8) is preferably 0 or 1.

$R_{62}$ is preferably a group of $R_{41}OCONH$—, a group of $R_{41}CONH$— or a group of $R_{41}SO_2NH$—. The position of $R_{62}$ is preferably the 5-position of the naphthol ring.

$R_{63}$ in the formula (Cp-9) is preferably a group of $R_{41}CONH$—, a group of $R_{41}SO_2NH$—, a group of $$R_{43}\underset{\underset{R_{44}}{|}}{N}SO_2-,$$

a group of $R_{41}SO_2$—, a group of $$R_{43}\underset{\underset{R_{44}}{|}}{N}CO-,$$

a nitro group or a cyano group.

$R_{63}$ in the formula (Cp-10) is preferably a group of $R_{43}OCO$—, a group of $R_{43}CO$— or a group of $R_{43}CO$- or a group $$R_{43}\underset{\underset{R_{44}}{|}}{N}CO-.$$

The above aliphatic group and aromatic group for $R_{51}$ to $R_{63}$ each has the same meaning as defined for $R_{41}$.

Representative examples of $R_{51}$ to $R_{63}$ are set forth below.

Examples of $R_{51}$ include a tert-butyl group, a 4-methoxyphenyl group, a phenyl group, a 3-[2-(2,4-di-tert-amylphenoxy)butanamido]phenyl group, a 4-octadecyloxyphenyl group and a methyl group, etc.

Examples of $R_{52}$ and $R_{53}$ include a 2-chloro-5-dodecyloxycarbonylphenyl group, a 2-chloro-5-hexadecylsulfonamidophenyl group, a 2-chloro-5-tetradecanamidophenyl group, a 2-chloro-5-[4-(2,4-di-tert-amylphenoxy)butanamido]phenyl group, a 2-chloro-5-[2-(2,4-di-tert-amylphenoxy)butanamido]phenyl group, a 2-methoxyphenyl group, a 2-methoxy-5-tetradecyloxycarbonylphenyl group, a 2-chloro-5-(1-ethoxycarbonylethoxycarbonyl)phenyl group, a 2-pyridyl group, a 2-chloro-5-octyloxycarbonyl phenyl group, a 2,4-dichlorophenyl group, a 2-chloro-5-(1-dodecyloxycarbonylethoxycarbonyl)phenyl group, a 2-chlorophenyl group, and a 2-ethoxyphenyl group, etc.

Examples of $R_{54}$ include a 3-[2-(2,4-di-tert-amylphenoxybutanamido]benzamido group, a 3-[4-(2,4-di-tert-amylphenoxy)butanamido]benzamido group, a 2-chloro-5-tetradecanamidoanilino group, a 5-(2,4-di-tert-amylphenoxyacetamido)-benzamido group, a 2-chloro-5-dodecenylsuccinimidoanilino group, a 2-chloro-5-[2-(3-tert-butyl-4-hydroxyphenoxy)tetradecanamido]anilino group, a 2,2-dimethylpropanimido group, a 2-(3-pentadecylphenoxy)butanamido group, a pyrrolidino group, and an N,N-dibutylamino group, etc.

Examples of $R_{55}$ include a 2,4,6-trichlorophenyl group, a 2-chlorophenyl group, a 2,5-dichlorophenyl group, a 2,3-dichlorophenyl group, a 2,6-dichloro-4-methoxyphenyl group, a 4-[2-(2,4-di-tert-amylphenoxy)butanamido]-phenyl group, or a 2,6-dichloro-4-methanesulfonylphenyl group, etc.

Examples of $R_{56}$ include a methyl group, an ethyl group, an isopropyl group, a methoxy group, an ethoxy group, a methylthio group, an ethylthio group, a 3-phenylureido group, a 3-butylureido group, and a 3-(2,4-di-tert-amylphenoxy)propyl group, etc.

Examples of $R_{57}$ include a 3-(2,4-di-tert-amylphenoxy)propyl group, a 3-[4-{2-[4-(4-hydroxyphenylsulfonyl)-phenoxy]tetradecanamido}phenyl]propyl group, a methoxy group, an ethoxy group, a methylthio group, an ethylthio group, a methyl group, a 1-methyl-2-{2-octyloxy-5-[2-octyloxy-5-(1,1,3,3-tetramethylbutyl)-phenylsulfonamido]-phenylsulfonamido}ethyl group, a 3-[4-(4-dodecyloxyphenylsulfonamido)phenyl]propyl group, a 1,1-dimethyl-2-[2-octyloxy-5-(1,1,3,3-tetramethylbutyl)phenylsulfonamido]-ethyl group, and a dodecylthio group, etc.

Examples of $R_{58}$ include a 2-chlorophenyl group, a pentafluorophenyl group, a heptafluoropropyl group, a 1-(2,4-di-tert-amylphenoxy)propyl group, a 3-(2,4-di-tert-amylphenoxy)propyl group, a 2,4-di-tert-amylmethyl group, and a furyl group, etc.

Examples of $R_{59}$ include a chlorine atom, a methyl group, an ethyl group, a prophyl group, a butyl group, an isopropyl group, a 2-(2,4-di-tert-amylphenoxy)-butanamido group, a 2-(2,4-di-tert-amylphenoxy)hexanamido group, a 2-(2,4-di-tert-octylphenoxy)octanamido group, a 2-(2-chloro phenoxy)tetradecanamido group, a 2,2-dimethylpropanamido group, a 2-[4-(4-hydroxyphenylsulfonyl)-phenoxy]tetradecanamido group, and a 2-[2-(2,4-di-tert-amylphenoxyacetamido)-phenoxy]butanamido group, etc.

Examples of $R_{60}$ include a 4-cyanophenyl group, a 2-cyanophenyl group, a 4-butylsulfonylphenyl group, a 4-propylsulfonylphenyl group, a 4-ethoxycarbonylphenyl group, a 4-N,N-diethylsulfamoylphenyl group, a 3,4-dichlorophenyl group, and a 3-methoxycarbonylphenyl group, etc.

Examples of $R_{61}$ include a dodecyl group, a hexadecyl group, a cyclohexyl group, a butyl group, a 3-(2,4-di-tert-amylphenoxy)propyl group, a 4-(2,4-di-tert-amylphenoxy)butyl group, a 3-dodecyloxypropyl group, a 2-tetradecyloxyphenyl group, a tert-butyl group, a 2-(2-hexadecyloxy)phenyl group, a 2-methoxy-5-dodecyloxycarbonylphenyl group, a 2-butoxyphenyl group, and a 1-naphthyl group, etc.

Examples of $R_{62}$ include an isobutyloxycarbonylamino group, an ethoxycarbonylamino group, a phenylsulfonylamino group, a methanesulfonamido group, a butanesulfonamide group, a 4-methylbenzenesulfonamide group, a benzamide group, a trifluoroacetamide group, a 3-phenylureido group, a butoxycarbonylamino group, and an acetamide group, etc.

Examples of $R_{63}$ include a 2,4-di-tert-amylhenoxyacetamide group, a 2-(2,4-di-tert-amyl phenoxy)-butanamide group, a hexadecylsulfonamide group, an N-methyl-N-octadecylsulfamoyl group, an N,N-dioctylsulfamoyl group, a dodecyloxycarbonyl group, a chlorine atom, a fluorine atom, a nitro group, a cyano group, an N-3-(2,4-di-tert-amylphenoxy)propylsulfamoyl group, an N-4-(2,4-di-tert-amylphenoxy)butylcarbamoyl group, a methanesulfonyl group, and a hexadecylsulfonyl group, etc.

Preferred specific examples of the compounds represented by the formula (I) useful in the present invention are set forth below, but the present invention should not be construed as being limited thereto.

(Compound)

(1)

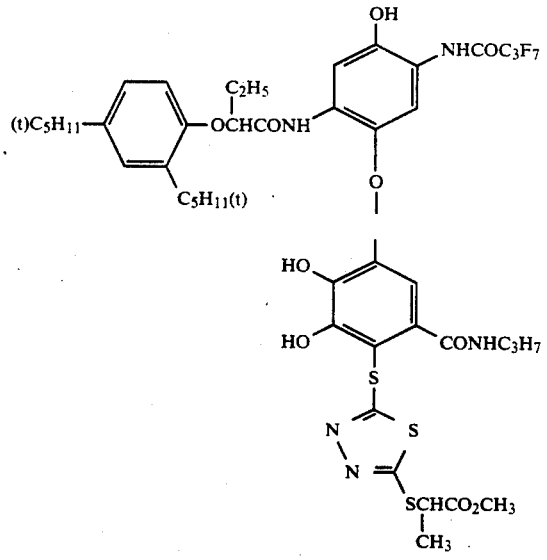

(2)

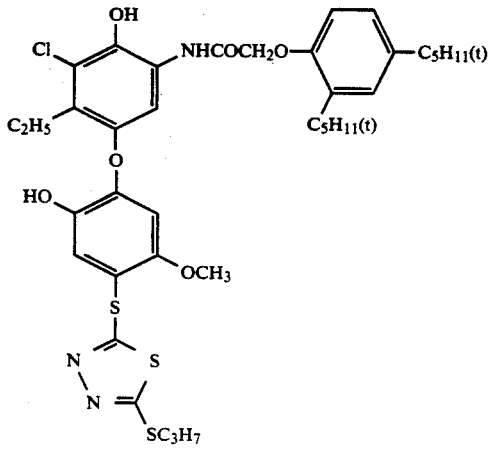

-continued
(Compound)
(3)
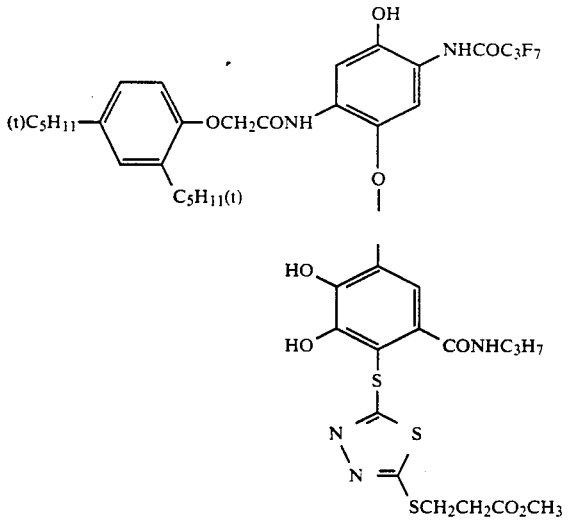
(4)
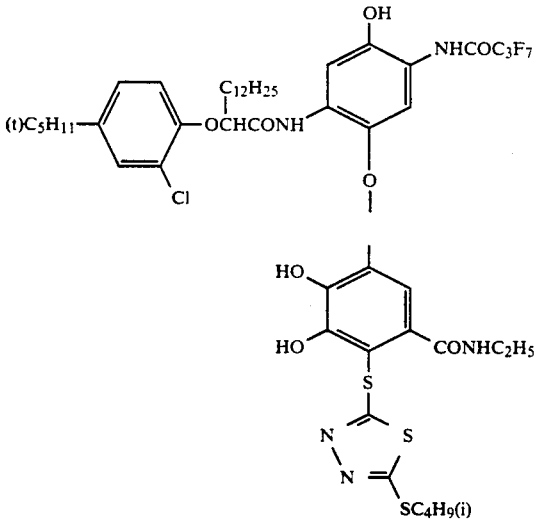
(5)
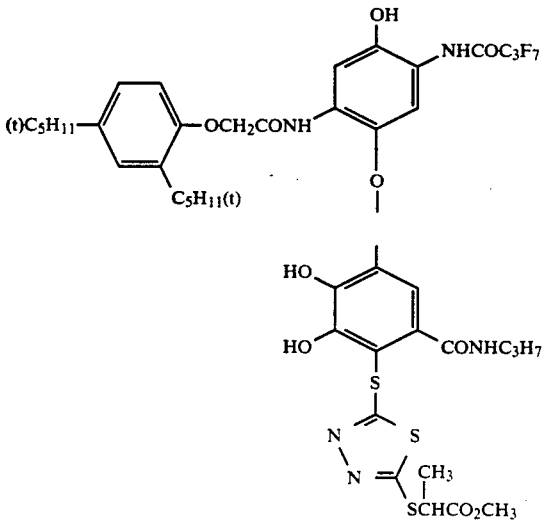

-continued
(Compound)
(6)
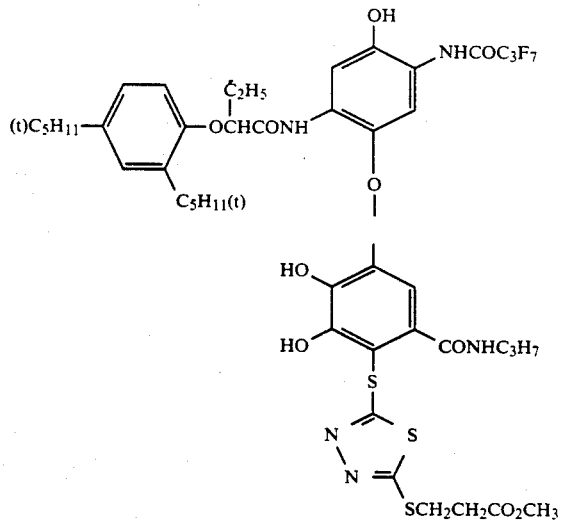
(7)
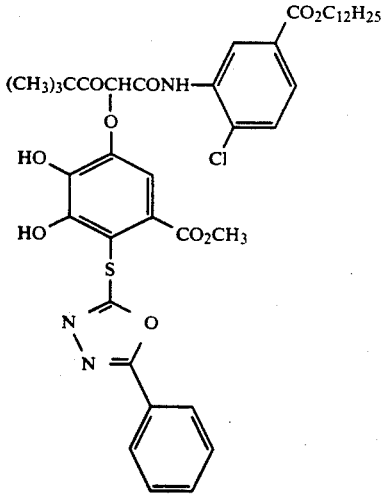
(8)
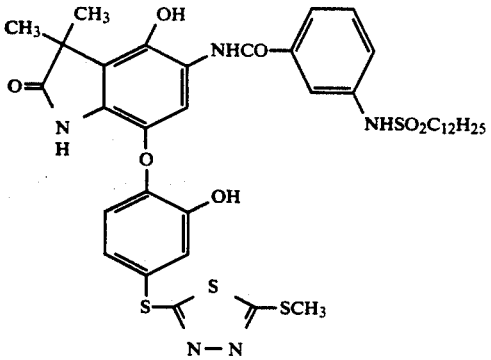
(9)
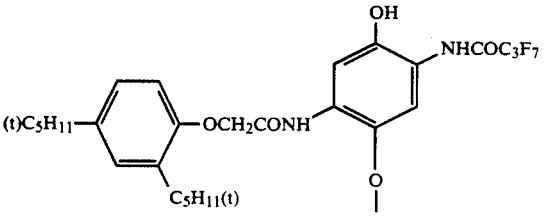

-continued
(Compound)
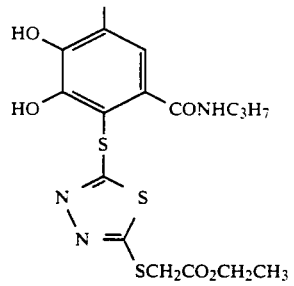
(10)
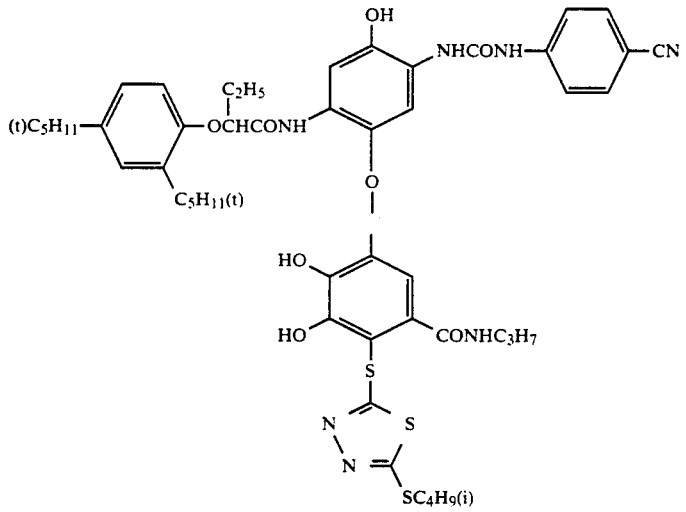
(11)
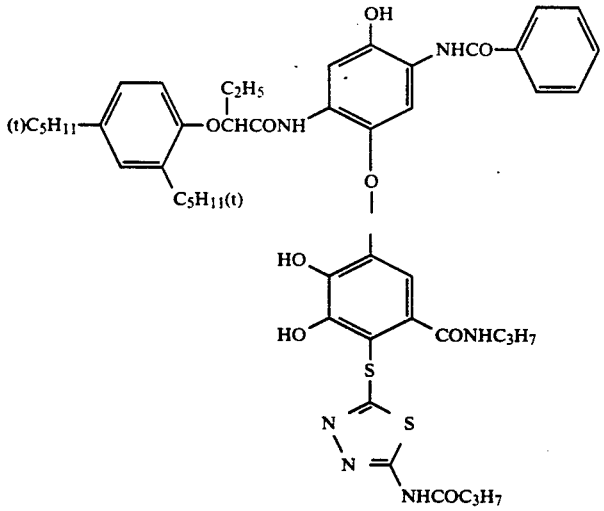
(12)
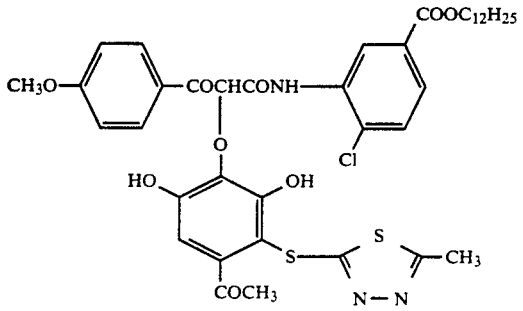

-continued
(Compound)
(13)
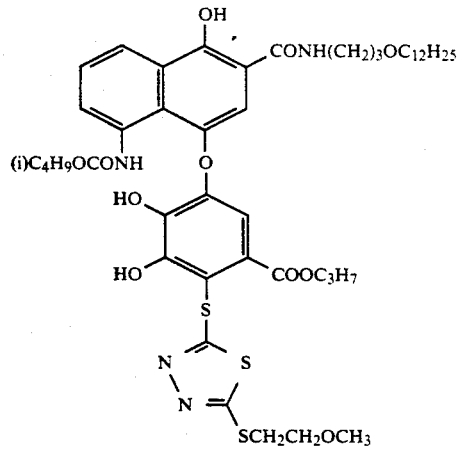
(14)
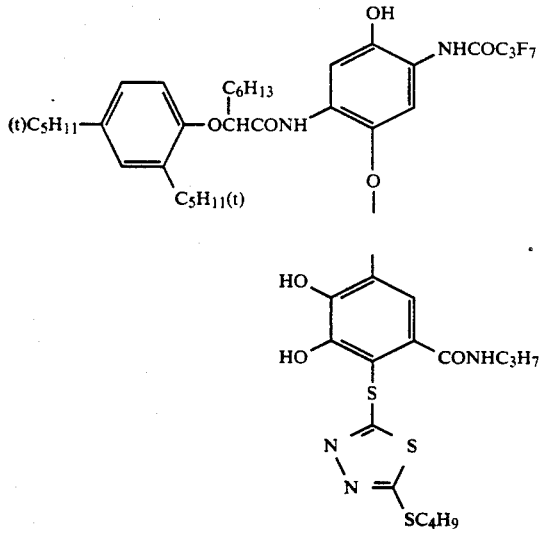
(15)
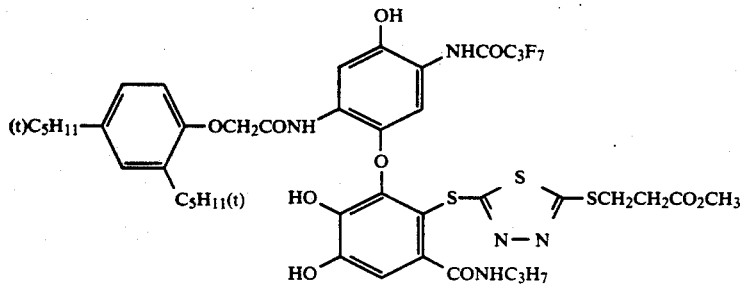
(16)
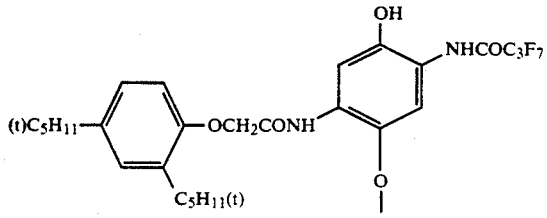

-continued
(Compound)
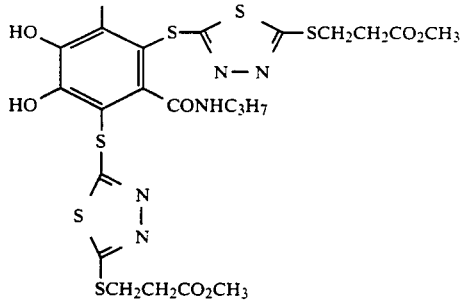
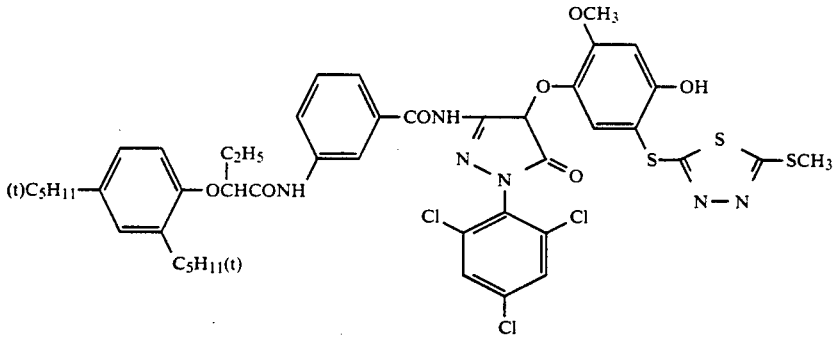
(17)
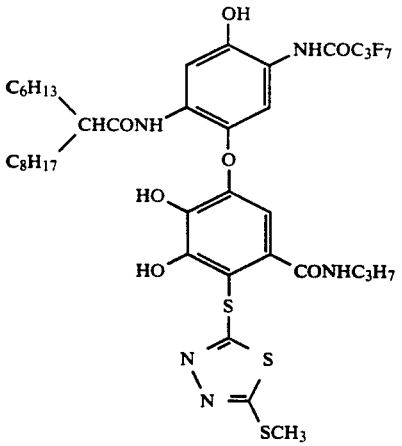
(18)
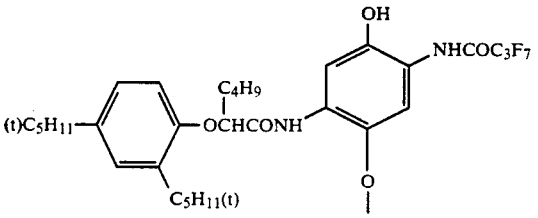
(19)

-continued
(Compound)
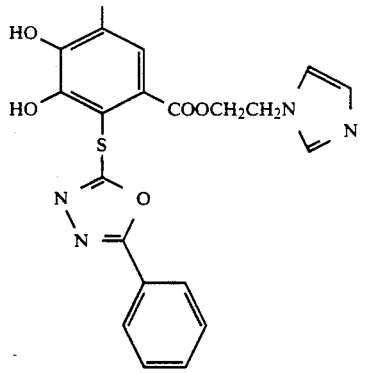
(20)
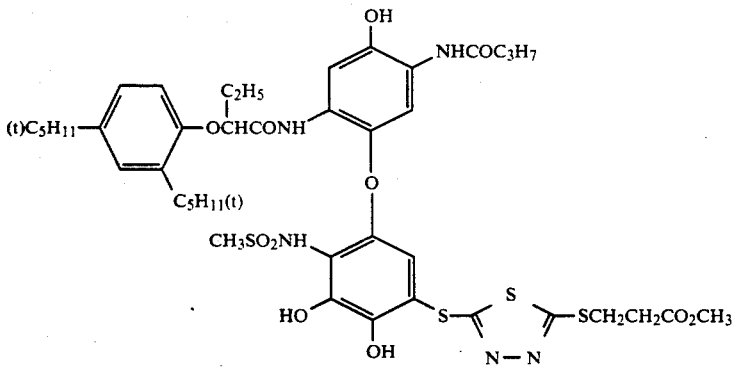
(21)
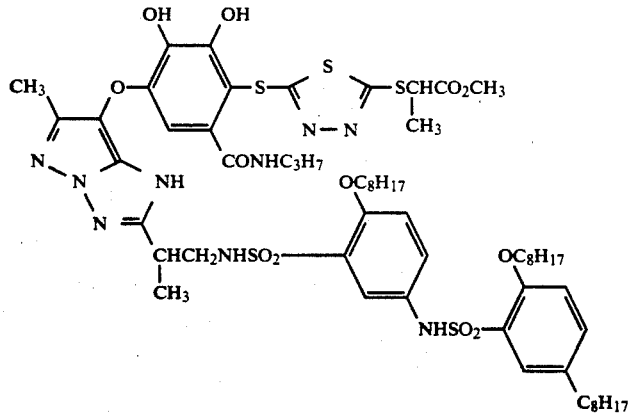
(22)
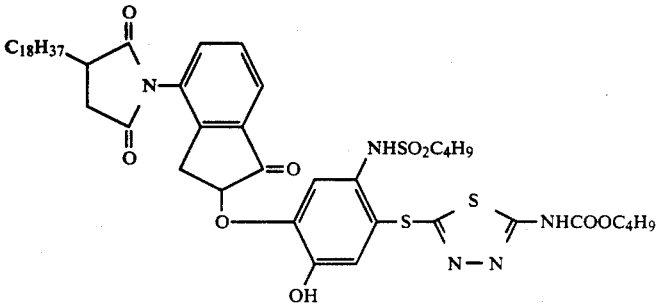

-continued
(Compound)
(23)
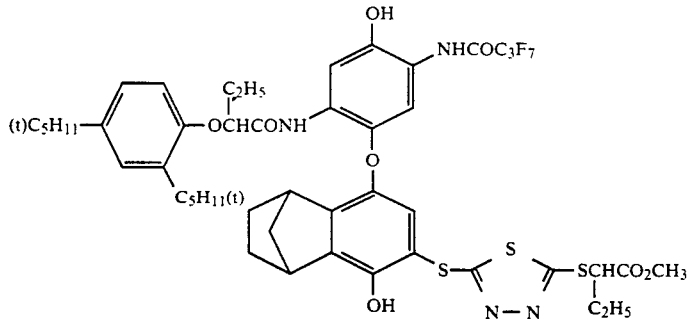
(24)
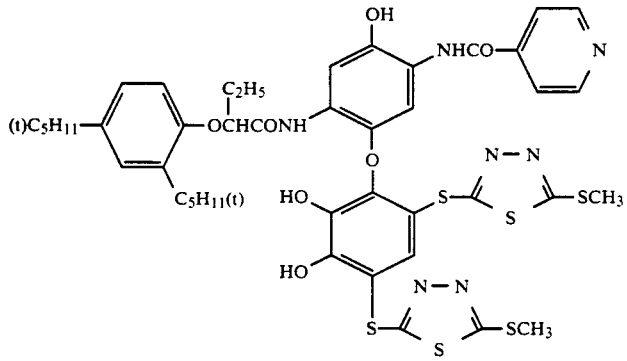
(25)
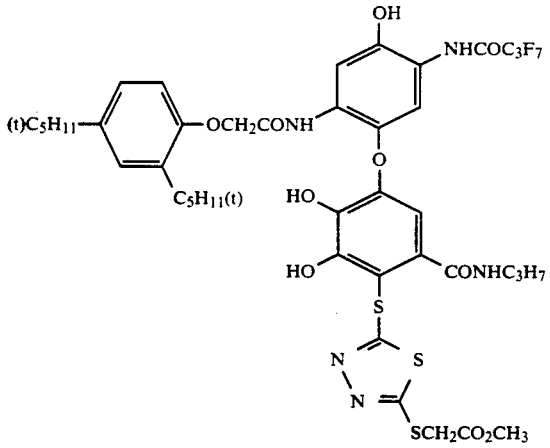
(26)
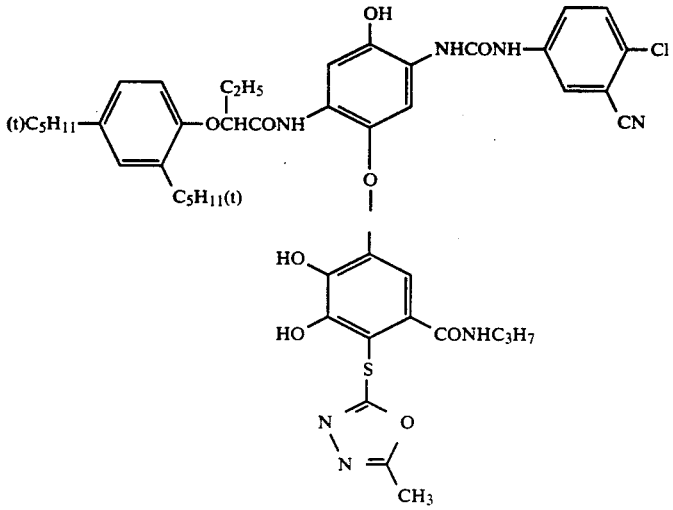

-continued
(Compound)
(27)
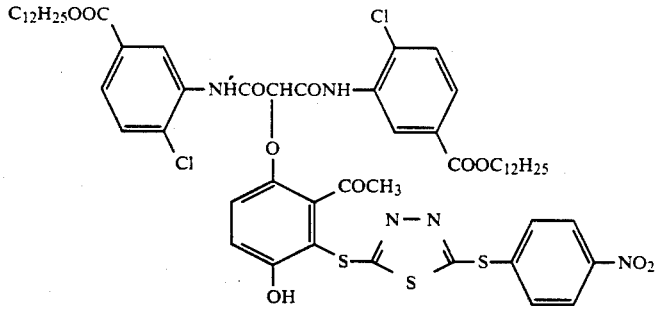
(28)
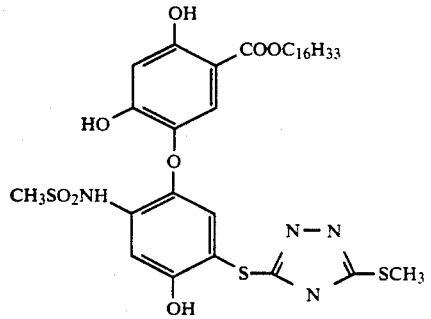
(29)
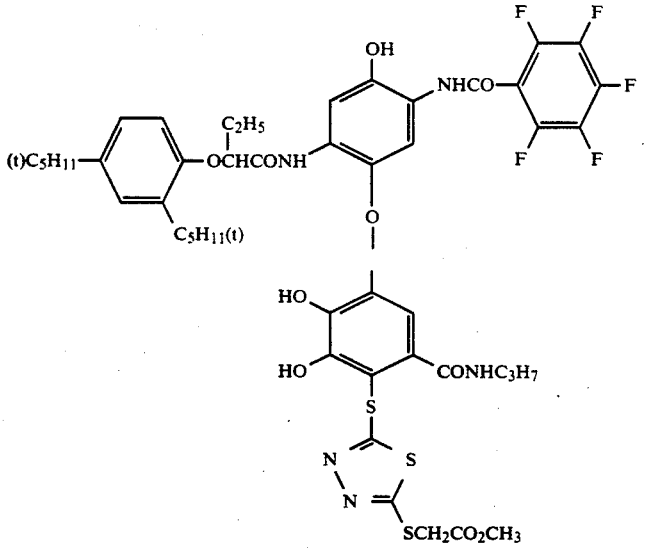
(30)
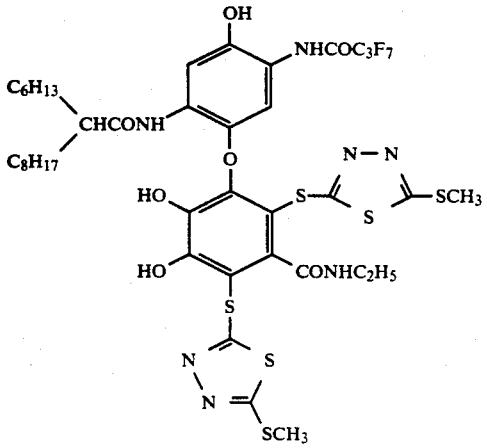

-continued
(Compound)
(31)
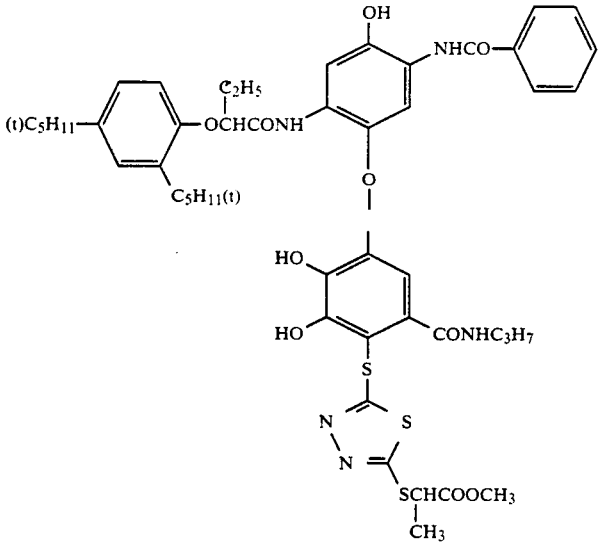
(32)
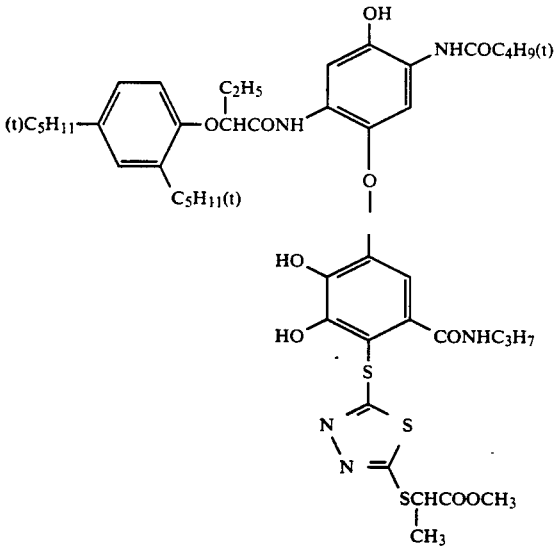
(33)
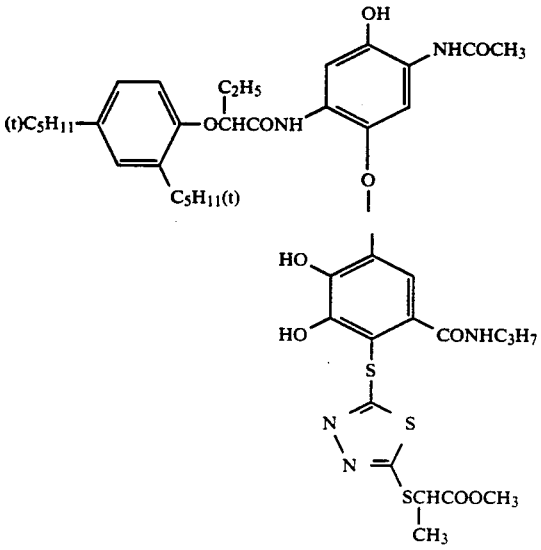

-continued (Compound)

(34)

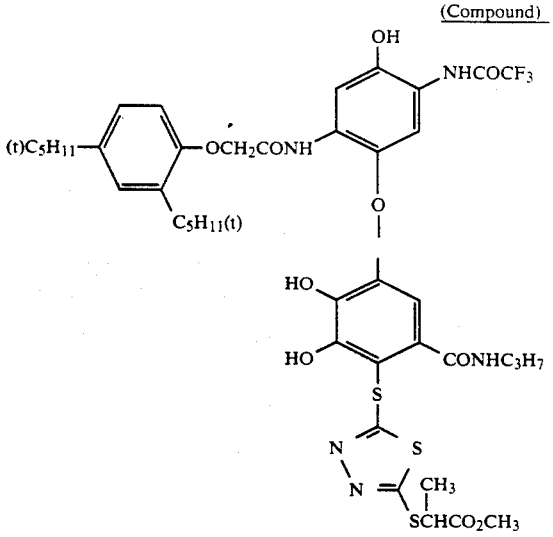

(35)

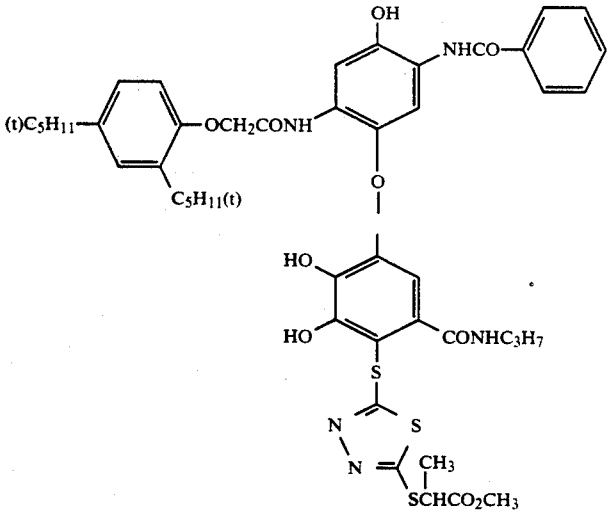

(36)

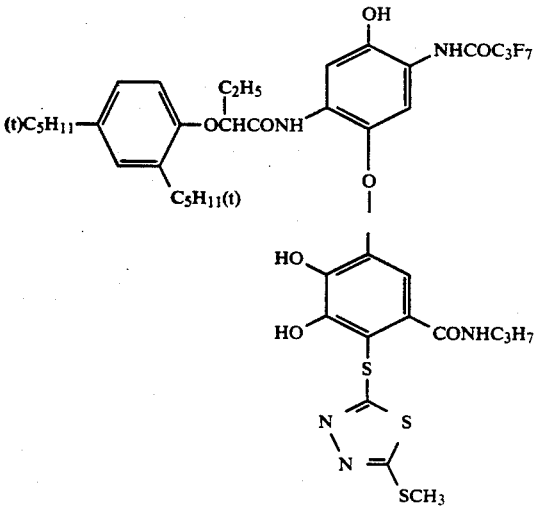

Further, as the compounds represented by the formula (I), those described in Japanese Patent Application No. 81962/87 (corresponding to U.S. patent application Ser. No. 177,227 filed on Apr. 4, 1988) and Japanese Patent Application 117635/87 filed on May 14, 1987 (Applicant: Fuji Photo Film Co., Ltd.; Title of the invention: Silver halide color photographic lightsensitive material) may also be employed.

The compounds represented by the formula (I) (II) or (V) can be easily synthesized with reference to the methods as described in the above-mentioned patent applications.

The compound represented by the formula (I) (II) or (V) used in the present invention is preferably incorporated into at least one of a light-sensitive silver halide emulsion layer and an adjacent layer thereto of the color photographic lightsensitive material. The amount of the compound added is generally in a range from $1\times10^{-6}$ to $1\times10^{-3}$ mol preferably from $3\times10^{-6}$ to $5\times10^{-4}$ mol, and more preferably from $1\times10^{-5}$ to $2\times10^{31\ 4}$ mol, per $m^2$ of the silver halide color photographic material.

The compound represented by the formula (I) (II) or (V) according to the present invention can be incorporated into the color photographic light-sensitive material in a manner similar to conventional couplers as described hereinafter.

The compound represented by the formula (I) can be incorporated into a silver halide color photographic material, as any yellow, magenta, cyan or colorless dye forming coupler, in the present invention. The inventors have found that the influence due to the change in the composition of the processing solution in processing with low replenishment is remarkably reduced by employing at least one compound represented by the formula (I) (II) or (V) in a silver halide color photographic material and can achieve the exceptional low replenishment which has been desired.

Now, the processing according to the present invention will be described in greater detail below.

With respect to a color photographic light-sensitive material for photography, for example, a color negative film, a color developing replenisher of about 1200 ml per $m^2$ of the film is conventionally replenished at the time of color development. In fact, in the case of such an amount of replenisher, the change in processing performance which causes trouble occurs on rare occasions even when there is a small processing amount or changeable processing amount. However, when the amount of replenishment is reduced to 700 ml per $m^2$ or less, the foregoing problems become notably severe. The change in processing performance is grounded upon many factors interrelated with one another, which include gradation and increase in fog density caused by evaporation and concentration of the developing solution, soft gradation and decrease in fog density resulting from the oxidation of a color developing agent, and contrasty or soft gradation and increase or decrease in fog density due to an increase or decrease in bromine ion concentration based on variation of the processing amount, and it exhibits extremely complicated aspects. Therefore, there have not hitherto been found any means to solve such problems.

The inventors have found, however, that the above described problems are remarkably reduced by employing the compound represented by the formula (I) (II) or (V) in a color photographic light-sensitive material and that stable results are obtained in the processing with the reduced amount of replenisher such as 700 ml or less per $m^2$ of the silver halide color photographic material.

In the present invention, the amount of replenisher for a color developing solution is 700 or ml less per $m^2$ of the silver halide color photographic material. However, a preferred range for obtaining a more remarkable effect is from 100 ml per $m^2$ to 600 ml per $m^2$, and a more preferred range is from 200 ml per $m^2$ to 500 ml per $m^2$ of the silver halide color photographic material. Further, a batch processing in which the amount of replenisher is 0 ml may be employed in the present invention.

Color developing agents which can be used in the color developing solution or color developing replenisher according to the present invention are aromatic primary amine compounds and include known compounds which are widely employed in various color photographic processes. In the present invention, preferred color developing agents are those of the N,N-dialkyl-p-phenylenediamine type and specifically include the following:

(1) 4-(N-ethyl-N-β-hydroxyethylamino)-2-methylaniline sulfate
(2) 4-(N-ethyl-N-β-methanesulfonamidoethylamino)-2-methyl-aniline sulfate
(3) 4-(N-ethyl-N-β-methoxyethylamino)-2-methylaniline p-toluenesulfonate
(4) 4-(N,N-diethylamino)-2-methylaniline hydrochloride
(5) 4-(N-ethyl-N-dodecylamino)-2-methylaniline sulfate
(6) N,N-diethyl-p-phenylenediamine hydrochloride The color developing agent is generally added in a range from 0.005 mol to 0.05 mol, preferably from 0.01 mol to 0.04 mol, and particularly preferably from 0.015 mol to 0.03 mol, per liter of the color developing solution. To the color developing replenisher, the color developing agnet is preferably added in an amount so as to make a higher concentration than that in the above described color developing solution. The specific concentration thereof can be varied depending on the fixed amount of replenisher, however, it is generally in a range of from 1.05 times to 2.0 times, more frequently from 1.2 times to 1.8 times that in the color developing solution (i.e., tank solution.)

The above described color developing agents may be employed individually or in combination, depending on the purpose. Preferred combinations thereof include, for example, (1) and (2), (1) and (3), and (2) and (3) of the above described color developing agents.

In the present invention, it is preferred that the bromine ion concentration of the color developing solution is in a range of from 0.005 mol/l to 0.02 mol/l. For this purpose, the bromide content in the replenisher is preferably adjusted to 0.005 mol/l or less. In general, the bromide content in the replenisher should be set at a low level, as the amount of replenisher is reduced. In the present invention, it is particularly preferred that the replenisher does not substantially contain bromide for the purpose of performing extensive reduction in the amount of replenisher. The term "does not substantially contain bromide" means that an amount of bromide used is generally 0.003 mol/l or less, preferably 0.001 mol/l or less, and more preferably 0 mol/l.

Specific examples of the bromide include potassium bromide, sodium bromide, lithium bromide, hydrobromic acid, etc.

In the color developing solution and color developing replenisher, preservatives such as hydroxylamine, diethylhydroxylamine, triethanolamine, the compounds as described in West German Patent Application (OLS) No. 2,622,950, the compounds as described in Japanese Patent Application No. 265149/86 (corresponding to U.S. patent application Ser. No. 117,727), sulfites, hydrogen sulfites, etc. can be employed.

Further, various chelating agents can be added to the color developing solution and color developing replenisher for the purpose of softening hard water or masking metals. In the present invention, it is particularly preferred to use at least one compound represented by the following formula (III) or (IV):

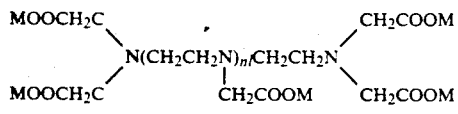

(III)

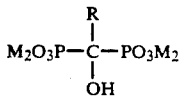

(IV)

wherein $n_1$ represents 1 or 2; R represents a lower alkyl group; M which may be the same or different, each represents a hydrogen atom, an alkali metal atom or an ammonium group.

In the formula (III) or (IV), R is preferably a methyl group or an ethyl group, and M is preferably a hydrogen atom or a sodium atom.

The above described compound has the effect of particularly restraining the change in gradation and fog density in the processing with low replenishment of the color photographic light-sensitive material containing the compound represented by the formula (I).

Therefore, the present invention is more effectively practiced by incorporating at least one compound represented by the formula (III) or (IV) into the color developing solution and color developing replenisher.

It is particularly preferred that at least one compound represented by the formula (III) and at least one compound represented by the formula (IV) are used together.

Specific examples of the compound represented by the formula (III) or (IV) are set forth below.

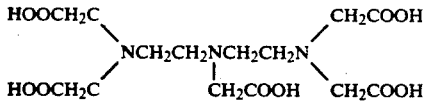

(III-1)

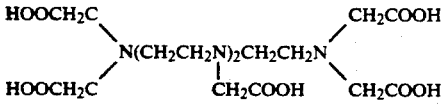

(III-2)

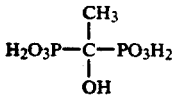

(IV-1)

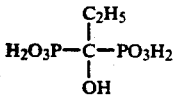

(IV-2)

The compound represented by the formula (III) can be added to the color developing solution and color developing replenisher in a range of generally from 0.0005 mol/l to 0.02 mol/l and preferably from 0.001 mol/l to 0.01 mol/l. Further, the compound represented by the formula (IV) can be added thereto in a range of generally form 0.002 mol/l to 0.1 mol/l and preferably from 0.005 mol/l to 0.05 mol/l.

In the case of using the compound represented by the formula (III) together with the compound represented by the formula (IV), the molar ratio of the compound represented by the formula (III) to the compound represented by the formula (IV) is in the range of generally from 2 to 20, preferably from 3 to 15, and more preferably from 3 to 10.

Of the examples of the compounds specifically described above, the combination of using Compound (III-1) together with Compound (IV-1) is particularly preferred.

In addition to the above described compounds, the color developing solution used in the present invention can further contain pH buffering agents, such as carbonates, borates or phosphates of alkali metals, etc.; development inhibitors or anti-fogging agents such as iodides, benzimidazoles, benzothiazoles or mercapto compounds, etc.; organic solvents such as diethylene glycol, etc.; development accelerators such as benzyl alcohol, polyethylene glycol, quanternary ammonium salts, amines, thiocyanates, etc.; nucleating agents such as sodium borohydride, etc.; auxiliary developing agents such as 1-phenyl-3-pyrazolidone, etc.; tackifiers; and various chelating agents other than the compounds represented by the formula (III) or (IV), for example, ethylenediaminetetraacetic acid, nitrilotriacetic acid, cyclohexanediaminetetraacetic acid, iminodiacetic acid, hydroxyethyliminodiacetic acid, organic phosphonic acids as described in *Research Disclosure,* No. 18170 (May, 1979), etc. individually or in a combination thereof.

The pH of the color developing solution and color developing replenisher used in the present invention is usually 9 or more, preferably from 9.5 to 12, and particularly preferably from 9.5 to 11.0. In the above described range, the pH of the replenisher is preferably adjusted higher than that of the color developing solution in a degree from about 0.05 to 0.3 pH units.

The temperature of the color development processing is generally in a range of from 30° to 45° C. It is desirable to conduct the process at high temperature in order to achieve the processing with excessively low replenishment. Accordingly, the color development is preferably performed at a temperature ranging from 35° to 45° C., particularly from 38° to 42° C. in the present invention.

The method of the present invention can be carried out either using an automatic developing machine or by hand, but it is preferred to employ an automatic developing machine. In processing by an automatic developing machine, the number of tanks for the developing solution may be one or two or more. It is possible, however, to further reduce the amount of replenisher by means of adopting a multistage direct-flow replenishment system in which plural tanks are used and replenishment is conducted into the first tank and the overflow is introduced into the next tank in order. Further, the contact area between the developing solution and the air in a tank is preferably minimized. Specifically, by using a shielding means, for example, a floating cover, sealing with a liquid having a high boiling point and a specific gravity lower than that of the developing solution, a tank structure having a narrow opening as described in Japanese Patent Application No. 278283/86, etc. the effect of the present invention can be further enhanced.

Moreover, in order to increase the effect of the present invention, it is preferred to replenish water corresponding to the amount of evaporation for the purpose of correcting for the concentration of the color developing solution. Water to be replenished is preferably deionized water obtained by ion exchange treatment or deionized water obtained by reverse permeation or distillation treatment.

The color developing solution and color developing replenishment can be prepared by adding the chemicals described above in order and dissolving in the fixed amount of water. The water used for the preparation is preferably the above described deionized water.

In the present invention, the photographic material after color development is subjected to processing with a bleaching solution or bleach-fixing solution. The bleaching agent used in these solutions is ordinarily a complex of a ferric ion and a chelating agent such as aminopolycarboxylic acid, polycarboxylic acid and an aminopolyphosphonic acid, etc.

Specific examples of preferred chelating agents which can be used to form the ferric ion complex are set forth below, but the present invention should not be construed as being limited thereto.

(1) Ethylenediaminetetraacetic acid
(2) Diethylenetriaminepentaacetic acid
(3) Cyclohexanediaminetetraacetic acid
(4) 1,3-Diaminopropanetetraacetic acid
(5) Nitrilotriacetic acid
(6) Iminodiacetic acid
(7) Glycol ether diaminetetraacetic acid The ferric ion complex salts may be used in the form of a complex salt per se or may be formed in situ in solution by using a ferric salt, for example, ferric sulfate, ferric chloride, ferric nitrate, ferric ammonium sulfate, or ferric phosphate, etc. and a chelating agent, for example, an aminopolycarboxylic acid, aminopolyphosphonic acid, or phosphonocarboxylic acid, etc. When they are used in the form of complex salts, they may be used alone or as a combination of two or more. On the other hand, where a complex is formed in situ in solution by using a ferric salt and a chelating agent, one or two or more ferric salts may be used. Further, one or two or more chelating agents may also be used. In every case, a chelating agent may be used in an excess amount of that necessary for forming a ferric ion complex salt. Of the ferric ion complexes, ferric complexes of aminopolycarboxylic acids are preferred.

In the case of color photographic light-sensitive materials for photographing such as color negative films, the amount of the ferric ion complex in the bleaching solution is generally from 0.1 mol to 1 mol and preferably from 0.2 mol to 0.4 mol per liter of the solution, and in the bleach-fixing solution it is generally from 0.05 mol to 0.5 mol and preferably from 0.1 to 0.3 mol per liter of the solution. On the other hand, in the case of color photographic light-sensitive materials for printing such as color papers, the amount thereof in the bleaching solution or bleach-fixing solution is generally from 0.03 mol to 0.3 mol and preferably from 0.05 mol to 0.2 mol per liter of the solution.

In the bleaching solution or the bleach-fixing solution, a bleach accelerating agent can be used, if desired. Specific examples of suitable bleach accelerating agents include compounds having a mercapto group or a disulfide group. These compounds are preferred in view of their large bleach accelerating effects. Particularly, the compounds as described in U.S. Pat. No. 3,893,858, West German Patent 1,290,812, and Japanese Patent Application (OPI) No. 95630/78 are preferred.

The bleaching solution or bleach-fixing solution used in the present invention can further contain rehalogenating agents such as bromides (for example, potassium bromide, sodium bromide, and ammonium bromide), chlorides (for example, potassium chloride, sodium chloride, and ammonium chloride), or iodides (for example, ammonium iodide). Moreover, one or more kinds of inorganic acids, organic acids, alkali metal salts or ammonium salts thereof which have a pH buffering ability (for example, boric acid, borax, sodium metaborate, acetic acid, sodium acetate, sodium carbonate, potassium carbonate, phosphorous acid, phosphoric acid, sodium phosphate, citric acid, sodium citrate, and tartaric acid), or corrosion preventing agents (for example, ammonium nitrate and guanidine) may be added, if desired.

The above-described bleaching solution can be employed in a pH range usually of from 4 to 7, preferably of from 4.5 to 6.5, and particularly preferably of from 5 to 6.3. On the other hand, the bleach-fixing solution can be used in a pH range usually of from 4 to 9, preferably of from 5 to 8, and particularly preferably of from 5.5 to 7.5. When the pH of the solution is higher than the above-described value, insufficient bleaching tends to occur. On the contrary, when the pH of the solution is lower than the above-described value, insufficient formation of cyan dyes is apt to occur.

As fixing agents which can be employed in the fixing solution which is used after the processing with the bleach-fixing solution or the fixing solution, known fixing agents, that is, water-soluble silver halide solvents such as thiosulfates (for example, sodium thiosulfate and ammonium thiosulfate); thiocyanates (for example, sodium thiocyanate and ammonium thiocyanate); thioether compounds (for example, ethylenebisthioglycolic acid and 3,6-dithia-1,8-octanediol); and thioureas may be used individually or as a combination of two or more. In addition, a special bleach-fixing solution comprising a combination of fixing agents and a large amount of a halide compound such as potassium iodide as described in Japanese Patent Application (OPI) No. 155354/76 can be used as well. In the present invention, a thiosulfate, particularly ammonium thiosulfate, is preferably employed.

The amount of the fixing agent used in the solution is preferably from 0.3 mol to 2 mol per liter of the solution, particularly from 0.8 mol to 1.5 mol per liter of the solution in the case of processing color photographic light-sensitive materials for photographing, and form 0.5 to 1 mol per liter of the solution in the case of processing color photographic light-sensitive materials for printing.

The pH of the fixing solution used in the present invention is preferably from 4 to 9 and particularly preferably form 5 to 8. When the pH of the fixing solution is lower than the above-described value, there is a tendency that deterioration of the solution is accelerated. On the contrary, when the pH of the solution is higher than the above-described value, release of ammonia from the ammonium salts present in the solution and increase in strain are apt to occur.

In order to adjust the pH, the fixing solution may contain, if desired, hydrochloric acid, sulfuric acid, nitric acid, acetic acid, a bicarbonate, ammonia, potassium hydroxide, sodium hydroxide, sodium carbonate, or potassium carbonate.

The bleach-fixing solution or fixing solution used in the present invention can contain, as preservatives, compounds capable of releasing sulfite ions such as sulfites (for example, sodium sulfite, potassium sulfite, and ammonium sulfite), bisulfites (for example, ammonium bisulfite, sodium bisulfite, and potassium bisulfite), and metabisulfites (for example, potassium metabisulfite, sodium metabisulfite, and ammonium metabisulfite). The amount of such a compound added is preferably from about 0.02 mol to about 0.50 mol and more preferably form about 0.04 mol to about 0.40 mol per liter of the solution calculated in terms of a sulfite ion.

While it is common to add sulfites as preservatives, other compounds such as ascorbic acid, a carbonylbisulfuric acid adduct, and a carbonyl compound may be added.

Further, buffers, fluorescent brightening agents, chelating agents, and antimold agent may be added, if desired.

After the fixing step or the bleach-fixing step, a processing step including water washing and stabilizing is generally conducted. It is also possible to employ a simplified processing method, that is, to carry out only a water washing step or to carry out only a stabilizing step without conducting a substantial water washing step.

The water washing step in the present invention has the function of removing the components of the processing solutions adhered to or contained in color photographic light-sensitive materials, and the components of the color photographic light-sensitive materials which are no longer necessary, in order to maintain preferable image preservability and the physical properties of the layers after processing.

The stabilizing step is a step capable of increasing image preservability to an extent which can not be obtained by the water washing step.

While the water washing step can be conducted in a single bath, a multi-stage countercurrent water washing system using two or more tanks is ordinarily employed. The amount of water required for the water washing step can be appropriately determined depending on the type and purpose of the color photographic light-sensitive material. For example, it can be calculated based on the method as described in S. R. Goldwasser, "Water Flow Rates in Immersion-Washing of Motion Picture Film" in *Journal of the Society of Motion Picture and Television Engineers,* Vol. 64, pages 248 to 253 (May, 1955).

In the case of reducing the amount of washing water, the propagation of bacteria or molds may cause problems. In order to solve such problems, it is preferred to employ water for washing in which the amounts of calcium and magnesium are reduced as described in Japanese Patent Application No. 131632/86 (corresponding to U.S. Patent Application Ser. No. 57,254 and European Patent Application No. 248,450A), or to add to the water for washing antibiotics and antimold agents, for example, the compounds described in *J. Antibact. Antifung. Agents,* Vol 11, No. 5, pages 207 to 223 (1983), H. Horiguchi, *Bokin-Bobai No Kagaku (Chemistry of Bacteria and Mold Inhibitor),* etc.

Further, a chelating agent, for example, ethylenediaminetetraacetic acid, diethylenetriaminepentaacetic acid, etc. may be added to the water.

In the case of saving the amount of washing water, it is generally used in a range from 100 ml to 2000 ml per $m^2$ of the color photographic light-sensitive material. Particularly, an amount of water within a range of from 200 ml to 1000 ml per $m^2$ is preferably used for attaining the effect on color image stability and the water saving effect simultaneously.

The pH range in the water washing step is usually from 5 to 9.

Further, various compounds can be added to the stabilizing bath for the purpose of stabilizing images. For example, it is possible to add various kinds of buffers for adjusting the pH of the layers after the processing (for example, borates, metaborates, borax, phosphates, carbonates, potassium hydroxide, sodium hydroxide, aqueous ammonia, monocarboxylic acids, dicarboxylic acids, polycarboxylic acids, etc., which can be used in combination also), chelating agents and antibacterial agents which are the same as those employed in the washing water. Further, fluorescent brightening agents may be added depending on the use, if desired. Moreover, it is possible to add various kinds of ammonium salts such as ammonium chloride, ammonium sulfite, ammonium sulfate, ammonium thiosulfate, etc.

The pH of the stabilizing bath is usually from 3 to 8. In some cases, a low pH ranged of from 3 to 5 may be preferably used depending on the type of photographic light-sensitive material and the end use purpose.

The present invention can be applied to various color photographic light-sensitive materials. Representative examples include color negative films for general use or motion pictures, color reversal films for slides or television, etc.

The silver halide emulsion used in the present invention can be prepared using the method as described in Research Disclosure, Vol.176, No. 17643, Item "I".

In the silver halide color photograhic material used in the present invention, any of silver bromide, silver iodobromide, silver iodochlorobromide, silver chlorobromide and silver chloride may be employed as the silver halide. In the case of photographic materials having high sensitivity, silver iodobromide (silver iodide content: 3 to 20 mol%) is preferably used.

Silver halide grains in the photographic emulsion may have a regular crystal structure, for example, a cubic, octahedral, tetradecahedral or rhombic dodecahedral structure, etc., an irregular crystal structure, for example, a spherical structure, etc., a crystal defect, for example, a twin plane, etc., or a composite structure thereof.

The grain size of the silver halide may be varied and includes from fine grains having a diameter of projected area of 0.1 micron or less to large size grains having a diameter of projected area of 10 microns. Further, a monodispersed emulsion having a narrow grain size distribution and a poly-dispersed emulsion having a broad grain size distribution may be used.

Representative monodispersed emulsions are those comprising silver halide grains having an average grain size of about 0.1 micron or more and at least 95% by weight of the total silver halide grains having a size within the range of ±40% of the average grain size. In the present invention, it is preferred to employ a monodispersed emulsion comprising silver halide grains having an average grain size of from about 0.25 microns to 2 microns and at least 95% by weight or by number of particles of the total silver halide grains having a size within the range of ±20% of the average grain size.

The crystal structure of silver halide grains may be uniform, composed of different halide compositions between the inner portion and the outer portion, or may have a stratified structure. Examples of such emulsion grains are described in British Patent 1,027,146, U.S. Pat. Nos. 3,505,068 and 4,444,877, and Japanese Patent Application (OPI) No. 143331/85, etc.

Further, silver halide emulsions in which silver halide grains having different compositions are connected at epitaxial junctions may also be employed.

By employing tabular silver halide grains in the silver halide photographic emulsion used in the present invention, many advantages, for example, an increase in sensitivity including spectral sensitizing efficiency with a sensitizing dye, improvement in the relation between sensitivity and graininess, improvement in sharpness, improvement in development processing, an increase in covering power, and improvement in crossover, etc. can be attained. The tabular silver halide grains used herein are those having a diameter/thickness ratio of 5 or more, for example, those having a ratio of more than 8 and those having a ratio of from 5 to 8, etc.

The tabular silver halide grains may have uniform halogen composition or may be composed of two or more phase having different halogen compositions. For example, in the case of silver iodobromide, tabular silver iodobromide grains having a stratified structure composed of plural phases having an iodide content different from each other can be used.

Preferred examples of the halogen composition and halogen distribution in grains of the tabular silver halide grains are described in Japanese Patent Application (OPI) Nos. 113928/83 and 99433/84, etc.

Preferred methods for using the tabular silver halide grains in the present invention are described in detail in *Research Disclosure,* No. 22534 (January, 1983) and ibid., No. 25330 (May, 1985). In these references, for example, a method for using tabular grains based on the relation between the thickness of tabular grains and the optical properties thereof is described.

The silver halide photographic emulsion used in the present invention can be prepared using known methods, for example, those described in *Research Disclosure,* No. 17643 (December, 1978), pages 22 to 23, "I. Emulsion Preparation and Types" and ibid., No. 18716 (November, 1979), page 648, etc.

Various kinds of photographic additives which can be employed in the present invention are described, for example, in *Research Disclosure,* No. 17643 (December, 1978), pages 23 to 28 and ibid., No. 18716 (November, 1979), pages 648 to 651, and particularly relevant portions thereof are summarized in the table shown below.

| Kind of Additive | RD 17643 | RD 18716 |
|---|---|---|
| 1. Chemical Sensitizers | Page 23 | Page 648, right column |
| 2. Sensitivity Increasing Agents | — | Page 648, right column |
| 3. Spectral Sensitizers and Super Sensitizers | Pages 23 to 24 | Page 648, right column to page 649, right column |
| 4. Brightening Agents | Page 24 | — |
| 5. Antifoggants and Stabilizers | Pages 24 to 25 | Page 649, right column |
| 6. Light-Absorbers, Filter Dyes and Ultraviolet Ray Absorbers | Pages 25 to 26 | Page 649, right column to page 650 left column |
| 7. Antistaining Agents | Page 25 right column | Page 650, left column to right column |
| 8. Dye Image Stabilizers | Page 25 | — |
| 9. Hardeners | Page 26 | Page 651, left column |
| 10. Binders | Page 26 | Page 651, left column |
| 11. Plasticizers and Lubricants | Page 27 | Page 650, right column |
| 12. Coating Aids and Surfactants | Pages 26 to 27 | Page 650, right column |
| 13. Antistatic Agents | Page 27 | Page 650, right column |

In the present invention, various color couplers can be employed and specific examples thereof are described in the patents cited in *Research Disclosure,* No. 17643, "VII-C" to "VII-G" as mentioned above. As dye forming couplers, couplers capable of providing three primary colors (i.e., yellow, magenta and cyan) in the subtractive process upon color development are important. Specific examples of preferred diffusion-resistant, four-equivalent or two-equivalent couplers are described in the patents cited in *Research Disclosure,* No. 17643, "VII-C" and "VII-D" as mentioned above. In addition, couplers as described below are preferably employed in the present invention.

As typical yellow couplers used in the present invention, known yellow couplers of the oxygen atom releasing type and known yellow couplers of the nitrogen atom releasing type are exemplified. α-Pivaloylacetanilide type couplers are characterized by excellent fastness, particularly light fastness, of dyes formed, and α-benzoylacetanilide type couplers are characterized by providing high color density.

As magenta couplers used in the present invention, hydrophobic 5-pyrazolone type couplers and pyrazoloazole type couplers each having a ballast group may be employed. Of 5-pyrazolone type couplers, those substituted with an arylamino group or an acrylamino group at the 3-position thereof are preferred in view of hue and color density of the dye formed therefrom.

As cyan couplers used in the present invention, hydrophobic and diffusion-resistant naphthol type and phenol type couplers are exemplified. Typical examples thereof preferably include oxygen atom releasing type two-equivalent naphthol type couplers.

Cyan couplers capable of forming cyan dyes fast to humidity and temperature are preferably used in the present invention. Typical examples thereof include phenol type cyan couplers having an alkyl group higher than a methyl group at the meta-position of the phenol nucleus as described in U.S. Pat. No. 3,772,002, 2,5-diacylamino-substituted phenol type couplers, phenol type couplers having a phenolureido group at the 2-position thereof and an acrylamino group at the 5-position thereof, and 5-amidonaphthol type cyan couplers as described in European Patent 161,626A, etc.

Further, couplers capable of forming appropriately diffusible dyes can be used together in order to improve graininess. Specific examples of such types of magenta couplers are described in U.S. Pat. No. 4,336,237, etc. and those of yellow, magenta and cyan couplers are described in European Patent 96,570, etc.

Dye forming couplers and special couplers as described above may form polymers including dimers or more. Typical examples of polymerized dye forming couplers are described in U.S. Pat. No. 3,451,820, etc. Specific examples of polymerized magenta couplers are described in U.S. Pat. No. 4,367,282, etc.

Couplers capable of releasing a photographically useful residue during the course of coupling can also be employed preferably in the present invention. Specific examples of useful DIR couplers capable of releasing a development inhibitor are described in the patents cited in *Research Disclosure,* No. 17643, "VII-F" described above.

In the photographic light-sensitive material according to the present invention, couplers which release imagewise a nucleating agent, a development accelerator or a precursor thereof at the time of development can be employed. Specific examples of such compounds are described in British Patents 2,097,140 and 2,131,188, etc. Furthermore, DIR redox compound releasing couplers as described in Japanese Patent Application (OPI) No. 185950/85, etc., couplers capable of releasing a dye which turns to a colored form after being released as described in European Patent 173,302A, etc., etc. may be employed in the photographic light-sensitive material of the present invention.

The couplers used in the present invention can be introduced into the photographic light-sensitive material according to various known dispersing methods. Specific examples of the organic solvents having a high boiling point which cna be employed in an oil droplet in water type dispersion method are described in U.S. Pat. No. 2,322,027, etc.

The processes and effects of latex dispersing methods and the specific examples of latexes for impregnation are described in U.S. Pat. No. 4,199,363, West German Patent Application (OLS) Nos. 2,541,274 and 2,541,230, etc.

The present invention is explained in greater detail with reference to the following examples, but the present invention should not be construed as being limited thereto.

Unless otherwise specified, all percents, ratios, etc., are by weight.

EXAMPLE 1

Sample 101:

On a cellulose triacetate film support provided with a subbing layer were coated layers having the compositions set forth below to prepare a multilayer color photographic light-sensitive material, which was designated as Sample 101.

With respect to the compositions of the layers, coated amounts are shown in units of g/m$^2$, coated amounts of silver halide and colloidal silver are shown by a silver coated amount in units of g/m$^2$, those of sensitizing dyes and couplers are shown as a molar amount per mol of silver halide present in the layer.

| | |
|---|---|
| First Layer: | |
| Antihalation Layer | |
| Black colloidal silver | 0.18 (as silver) |
| Gelatin | 1.40 |
| Second Layer: | |
| Interlayer | |
| 2,5-Di-tert-pentadecylhydroquinone | 0.18 |
| C-1 | 0.07 |
| C-3 | 0.02 |
| U-1 | 0.08 |
| U-2 | 0.08 |
| HBS-1 | 0.10 |
| HBS-2 | 0.02 |
| Gelatin | 1.04 |
| Third Layer: | |
| First Red-Sensitive Emulsion Layer | |
| Silver Iodobromide Emulsion (silver iodide content: 6 mol %, average grain size: 0.8 μm) | 0.50 (as silver) |
| Sensitizing Dye IX | $6.9 \times 10^{-5}$ |
| Sensitizing Dye II | $1.8 \times 10^{-5}$ |
| Sensitizing Dye III | $3.1 \times 10^{-4}$ |
| Sensitizing Dye IV | $4.0 \times 10^{-5}$ |
| C-2 | 0.146 |
| HBS-1 | 0.005 |
| Compound (1) of the present invention | 0.005 |
| Gelatin | 1.20 |
| Fourth Layer: | |
| Second Red-Sensitive Emulsion Layer | |
| Silver Iodobromide Emulsion (silver iodide content: 5 mol %, average grain size: 0.85 μm | 1.15 (as silver) |
| Sensitizing Dye IX | $5.1 \times 10^{-5}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| C-2 | 0.060 |
| C-3 | 0.008 |
| Compound (1) of the present invention | 0.004 |
| HBS-1 | 0.005 |
| Gelatin | 1.50 |
| Fifth Layer: | |
| Third Red-Sensitive Emulsion Layer | |
| Silver Iodobromide Emulsion (silver iodine content: 10 mol %, average grain size: 1.5 μm | 1.50 (as silver) |
| Sensitizing Dye IX | $5.4 \times 10^{-5}$ |
| Sensitizing Dye II | $1.4 \times 10^{-5}$ |
| Sensitizing Dye III | $2.4 \times 10^{-4}$ |
| Sensitizing Dye IV | $3.1 \times 10^{-5}$ |
| C-5 | 0.012 |
| C-3 | 0.003 |
| C-4 | 0.004 |
| HBS-1 | 0.32 |
| Gelatin | 1.63 |
| Sixth Layer: | |
| Interlayer | |
| Gelatin | 1.06 |
| Seventh Layer: | |
| First Green-Sensitive Emulsion Layer | |
| Silver Iodobromide Emulsion (silver iodide content: 6 mol %, average grain size: 0.8 μm) | 0.35 (as silver) |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |
| C-6 | 0.120 |
| C-1 | 0.021 |
| C-7 | 0.030 |
| C-8 | 0.025 |
| HBS-1 | 0.29 |
| HBS-4 | 0.008 |
| Gelatin | 0.70 |
| Eighth Layer: | |
| Second Green-Sensitive Emulsion Layer | |
| Silver Iodobromide Emulsion (silver iodide content: 5 mol %, average grain size: 0.85 μm) | 0.75 (as silver) |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| C-6 | 0.021 |
| C-8 | 0.004 |
| C-1 | 0.002 |
| C-7 | 0.003 |
| HBS-1 | 0.15 |
| HBS-4 | 0.010 |
| Gelatin | 0.80 |
| Ninth Layer: | |
| Third Green-Sensitive Emulsion Layer | |
| Silver Iodobromide Emulsion (silver iodide content: 10 mol %, average grain size: 1.5 μm) | 1.80 (as silver) |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| C-16 | 0.012 |
| C-1 | 0.001 |
| HBS-2 | 0.69 |
| Gelatin | 1.74 |
| Tenth Layer: | |

-continued

| | |
|---|---|
| Yellow filter Layer | |
| Yellow Coloidal Silver | 0.05 (as silver) |
| 2,5-Di-tert-pentadecylhydroquinone | 0.03 |
| Gelatin | 0.95 |
| Eleventh Layer: | |
| First Blue-Sensitive Emulsion Layer | |
| Silver Iodobromide Emulsion (silver iodide content: 6 mol %, average grain size: 0.6 μm) | 0.24 (as silver) |
| Sensitizing Dye VIII | $3.5 \times 10^{-4}$ |
| C-9 | 0.27 |
| C-8 | 0.005 |
| HBS-1 | 0.28 |
| Gelatin | 1.28 |
| Twelfth Layer: | |
| Second Blue-sensitive Emulsion Layer | |
| Silver Iodobromide Emulsion (silver iodide content: 10 mol %, average grain size: 1.0 μm) | 0.45 (as silver) |
| Sensitizing Dye VIII | $2.1 \times 10^{-4}$ |
| C-9 | 0.098 |
| Compound (1) of the present invention | 0.010 |
| HBS-1 | 0.03 |
| Gelatin | 0.46 |
| Thirteenth Layer: | |
| Third Blue-Sensitive Emulsion Layer | |
| Silver Iodobromide Emulsion (silver iodide content: 10 mol %, average grain size: 1.8 μm | 0.77 (as silver) |
| Sensitizing Dye VIII | $2.2 \times 10^{-4}$ |
| C-9 | 0.036 |
| HBS-1 | 0.07 |
| Gelatin | 0.69 |

-continued

| | |
|---|---|
| Fourteenth Layer: | |
| First Protective Layer | |
| Silver Iodobromide (silver iodide content: 1 mol %, average grain size: 0.07 μm) | 0.5 (as silver) |
| U-1 | 0.11 |
| U-2 | 0.17 |
| Butyl p-hydroxybenzoic acid | 0.012 |
| HBS-1 | 0.90 |
| Gelatin | 1.20 |
| Fifteenth Layer: | |
| Second Protective Layer | |
| Polymethyl methacrylate particles (diameter: about 1.5 μm) | 0.54 |
| S-1 | 0.15 |
| S-2 | 0.10 |
| Gelatin | 0.72 |

Gelatin Hardener H-1 and a surface active agent were added to each of the layers in addition to the above described components.

Samples 102 to 105:

Samples 102 to 105 were prepared in the same manner as described for Sample 101 except using an equimolar amount of Compounds (3), (5) and (10) according to the present invention and Comparative Compound C-11 instead of Compound (1) according to the present invention added to the third layer, the fourth layer and twelfth layer of Sample 101, respectively.

The structures or names of the compounds used for the preparation of the samples in Examples 1 to 3 are shown below.

U-1

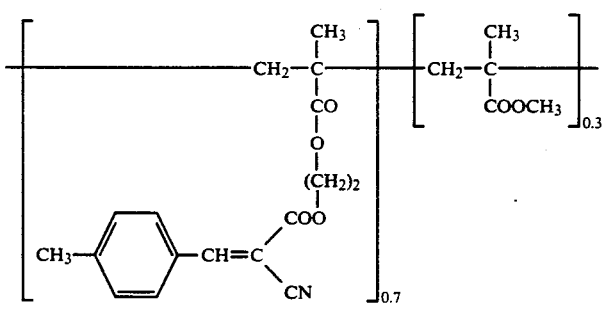

C-1

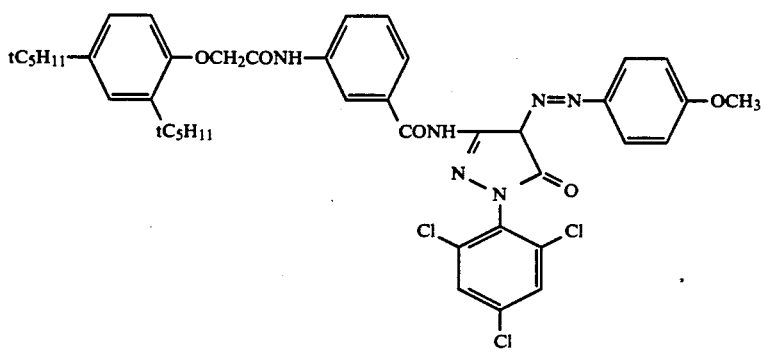

U-2

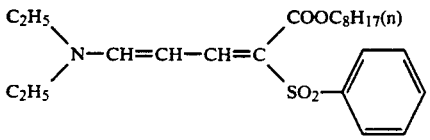

C-2

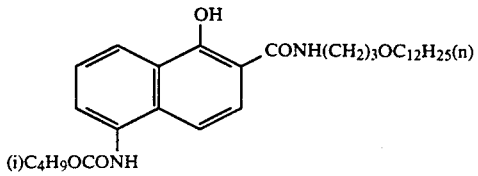

-continued
C-3
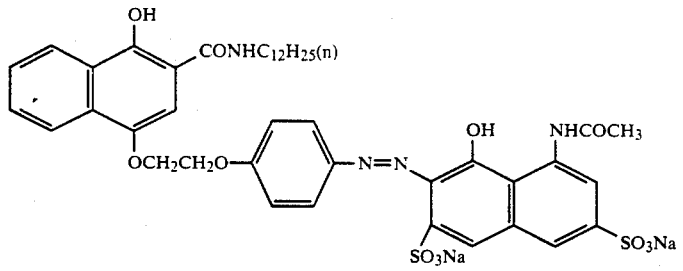
C-4
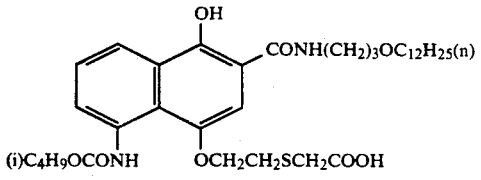
C-5
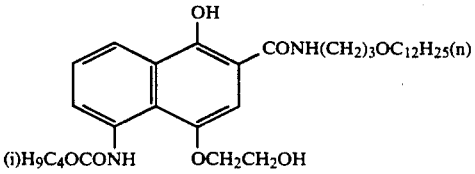
C-6
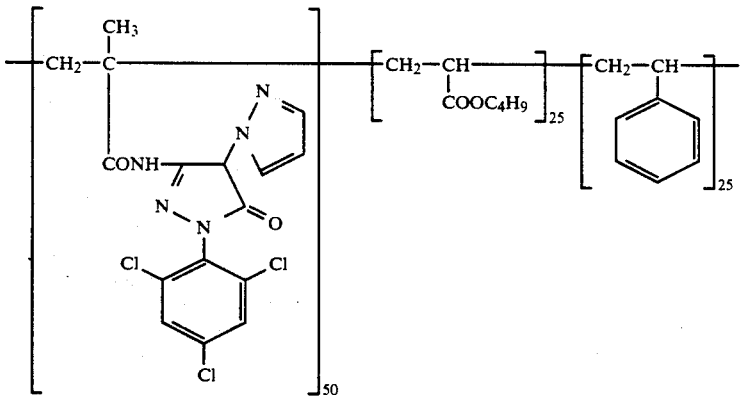
Average molecular weight: 30,000
C-7
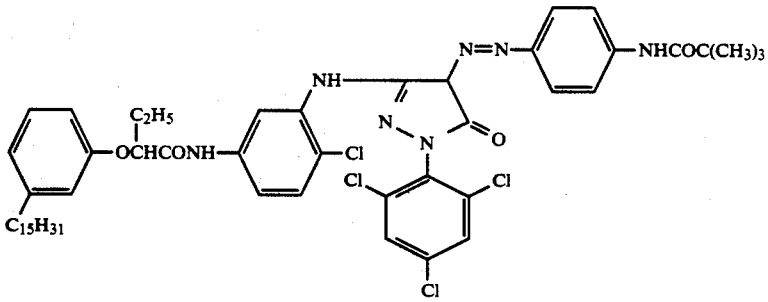
C-8
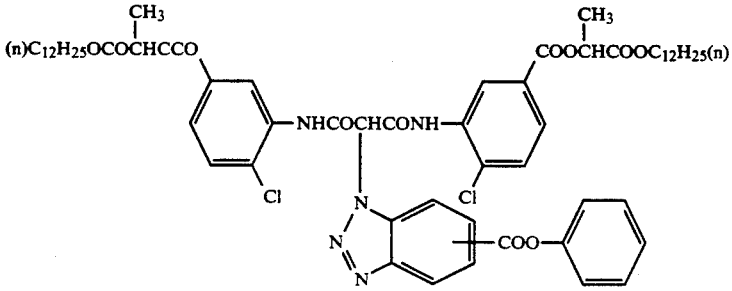

-continued
C-9
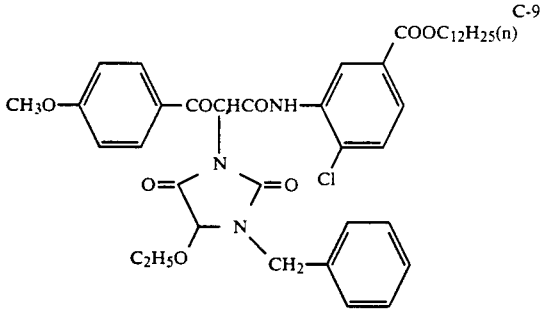
C-10
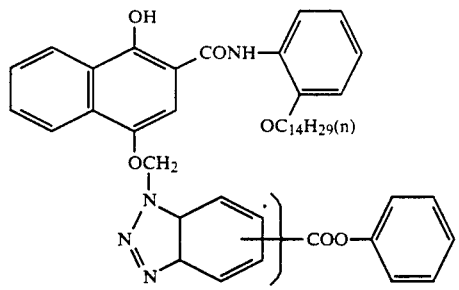
C-11
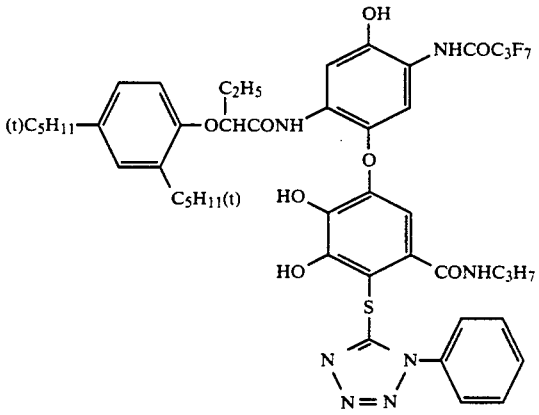
(Coupler as described in
Japanese Patent Application (OPI) No. 24252/87)
C-12
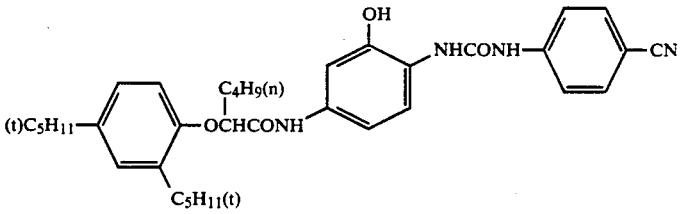
C-13
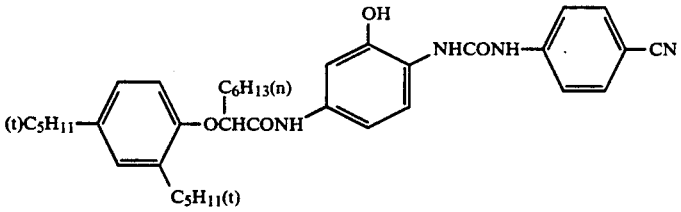
C-14
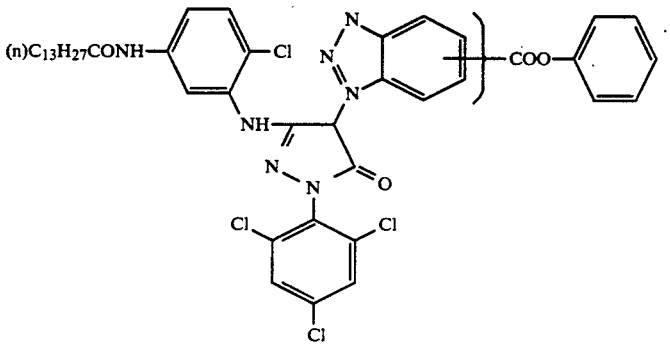

-continued
C-16
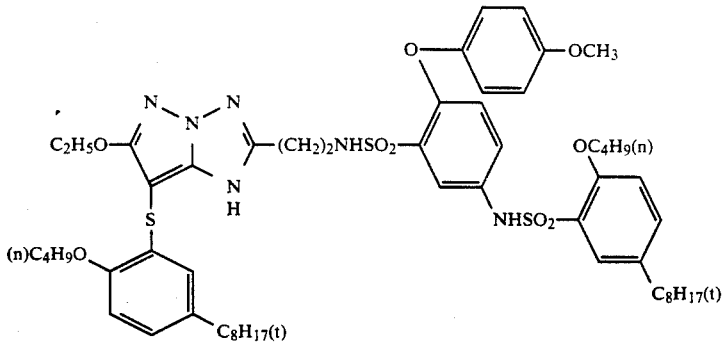
S-1
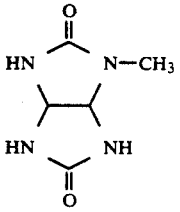
S-2
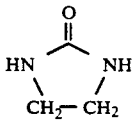
Tricresyl Phosphate HBS-1 Dibutyl Phthalate HBS-2
Tri-n-hexyl Phosphate HBS-3
HBS-4
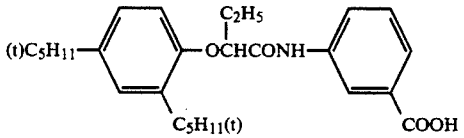
H-1
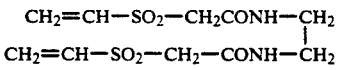
Sensitizing Dye:
I
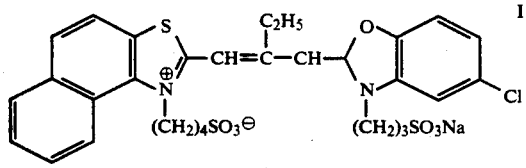
II
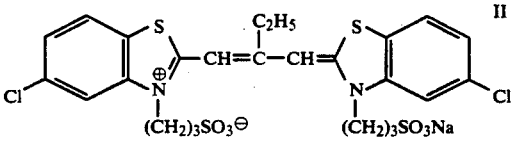
III
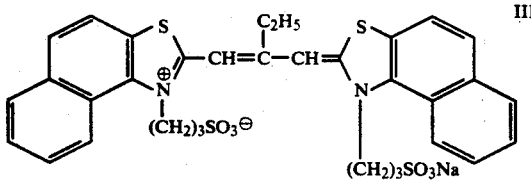
IV
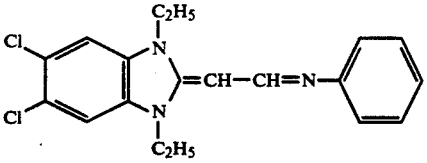
V
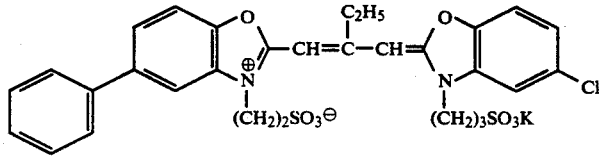
VI
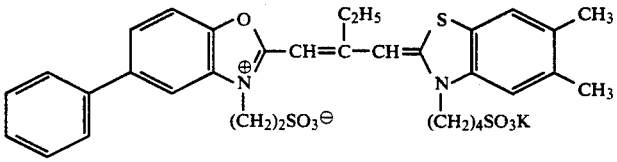

-continued

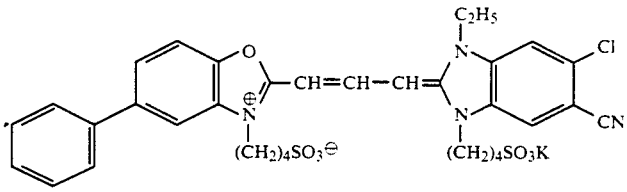

VII

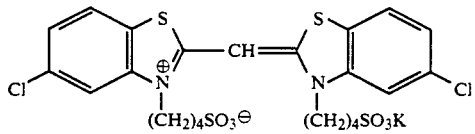

VIII

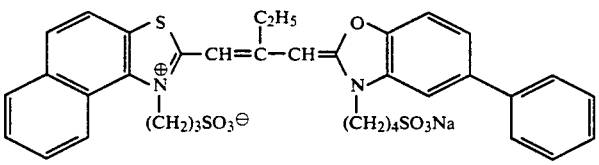

IX

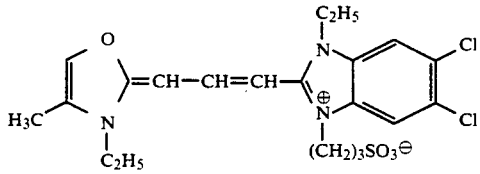

X

Samples 101 to 105 thus-prepared were each cut-through to a 35 mm width, subjected to wedge exposure in an exposure amount of 20 CMS at the color temperature of 4800° K. and then processed using an automatic developing machine according to the steps shown in Table 1 below. This processing was designated as $S_1$.

Then, Sample 101 was cut-through to a 35 mm width, exposed in a camera, and then continuously processed using an automatic developing machine according to Processing Nos. 1 to 4 as described in Table 2 below at the rate of 20 meter per day until the accumulated amount of color developing replenisher reached 20 liters.

TABLE 1

| Processing Step | Processing Time | Processing Temperature | Amount of* Replenisher | Capacity of Tank |
|---|---|---|---|---|
| Color Development | 3 min 15 sec | 38.0° C. | Shown in Table 2 | 10 l |
| Bleaching | 6 min 30 sec | 38.0° C. | 300 ml | 20 l |
| Fixing | 3 min 15 sec | 38.0° C. | 800 ml | 10 l |
| Washing with Water (1) | 1 min 00 sec | 35.0° C. | ** | 4 l |
| Washing with Water (2) | 1 min 40 sec | 35.0° C. | 800 ml | 4 l |
| Stabilizing | 1 min 20 sec | 38.0° C. | 800 ml | 4 l |
| Drying | 1 min 30 sec | 55.0° C. | — | — |

*Amount of replenisher per $m^2$ of the photographic light-sensitive material
**Countercurrent piping process from Washing with Water (2) to Washing with Water (1)

TABLE 2

| Processing No. | Amount of Color Developing Replenisher (per $m^2$ of photographic light-sensitive material) | Concentration in Color Developing Replenisher | |
|---|---|---|---|
| | | Developing Agent | Potassium Bromide |
| 1 | 1200 ml | 5.3 g/l | 0.7 g/l |
| 2 | 700 ml | 6.3 g/l | 0.4 g/l |

TABLE 2-continued

| Processing No. | Amount of Color Developing Replenisher (per $m^2$ of photographic light-sensitive material) | Concentration in Color Developing Replenisher | |
|---|---|---|---|
| | | Developing Agent | Potassium Bromide |
| 3 | 500 ml | 6.8 g/l | 0.1 g/l |
| 4 | 300 ml | 7.3 g/l | 0.0 g/l |

The composition of each processing solution used is illustrated below.

| | Tank Solution | Replenisher |
|---|---|---|
| Color Developing Solution: | | |
| Diethylenetriaminepentaacetic Acid | 1.0 g | 1.0 g |
| 1-Hydroxyethylidene-1,1-diphosphonic Acid | 3.0 g | 3.2 g |
| Sodium Sulfite | 4.0 g | 4.9 g |
| Potassium Carbonate | 30.0 g | 30.0 g |
| Potassium Bromide | 1.4 g | Shown in Table 2 |
| Potassium Iodide | 1.5 mg | — |
| Hydroxylamine Sulfate | 2.4 g | 3.6 g |
| 4-(N-Ethyl-N-β-hydroxyethylamino)-2-methylaniline Sulfate | 4.5 g | Shown in Table 2 |
| Water to make | 1.0 l | 1.0 l |
| pH | 10.05 | 10.10 |
| Bleaching Solution: | | |
| Iron (II) Sodium Ethylenediaminetetraacetate Trihydrate | 100.0 g | 140.0 g |
| Disodium Ethylenediaminetetraacetate | 10.0 g | 11.0 g |
| Ammonium Bromide | 140.0 g | 180.0 g |
| Ammonium Nitrate | 30.0 g | 40.0 g |
| Aqueous Ammonia (27 wt %) | 6.5 ml | 2.5 ml |
| Water to make | 1.0 l | 1.0 l |
| pH | 6.0 | 5.5 |
| Fixing Solution: | | |
| Disodium Ethylenediaminetetraacetate | 0.5 g | 1.0 g |

-continued

| | Tank Solution | Replenisher |
|---|---|---|
| Sodium Sulfite | 7.0 g | 12.0 g |
| Sodium Bisulfite | 5.0 g | 9.5 g |
| Ammonium Thiosulfate (700 g/l aq. soln.) | 170.0 ml | 240.0 ml |
| Water to make | 1.0 l | 1.0 l |
| pH | 6.7 | 6.6 |

Washing Water Solution: (both tank solution and replenisher)

City water was passed through a mixed bed type column filled with an H type strong acidic cation exchange resin (Amberlite IR-120B manufactured by Rohm & Haas Co.) and an OH type anion exchange resin (Amberlite IR-400 manufactured by Rohm & Haas Co.) to reduce both calcium ions and magnesium ions to a concentration not more than 3 mg per liter, and thus was added thereto sodium dichloroisocyanurate in an amount of 20 mg per liter and sodium sulfate in an amount of 1.5 g per liter.

The pH of the solution was in a range of from 6.5 to 7.5.

Stabilizing Solution:

| | Tank Solution | Replenisher |
|---|---|---|
| Formalin (37 wt %) | 2.0 ml | 3.0 ml |
| Polyoxyethylene-p-monomonylphenylether (average degree of polymerization = 10) | 0.3 g | 0.45 g |
| Disodium Ethylenediamine tetraacetate | 0.05 g | 0.08 g |
| Water to make | 1.0 l | 1.0 l |
| pH | 5.0 to 8.0 | 5.0 to 8.0 |

During the above-described continuous processing, Samples 101 to 105 were exposed imagewise in the same manner as described above and processed once a day. These processings were designated as $S_2$, $S_3$, . . . $S_n$, respectively. With respect to Samples 101 to 105, the maximum difference in gradation and the maximum difference in fog density were determined for $S_1$ to $S_n$, respectively, and are shown in Table 3 as the representative values of change in processing.

The fog density used herein means a value calculated by subtracting a density ($D_2$) obtained by subjecting the unexposed sample to processing from a fixing or bleach-fixing step to the final step without development from a density ($D_1$) obtained by subjecting the unexposed sample to processing from a development step to the final step (i.e., fog density $= D_1 - D_2$).

The gradation used herein means a value calculated by subtracting the minimum density + 0.2 from a value (d) of density corresponding to an exposure amount of a point which is determined by adding 1.5 in a logarithm value of amount of exposure (lux.sec) to a point of exposure amount providing a density of the minimum density + 0.2 (i.e., gradation = d − (the minimum density + 0.2)).

TABLE 3

| | Experimental No. | Processing No. | Sample | Maximum Difference in Gradation Density | | | Maximum Difference in Fog Density | | |
|---|---|---|---|---|---|---|---|---|---|
| | | | | Y | M | C | Y | M | C |
| Comparison | 1 | 1 | 105 | 0.03 | 0.03 | 0.02 | 0.02 | 0.02 | 0.03 |
| " | 2 | 2 | " | 0.05 | 0.04 | 0.06 | 0.03 | 0.03 | 0.05 |
| " | 3 | 3 | " | 0.08 | 0.07 | 0.08 | 0.03 | 0.04 | 0.06 |
| " | 4 | 4 | " | 0.12 | 0.12 | 0.15 | 0.05 | 0.05 | 0.08 |
| Comparison | 5 | 1 | 101 | 0.03 | 0.03 | 0.02 | 0.02 | 0.03 | 0.03 |
| Invention | 6 | 2 | " | 0.04 | 0.04 | 0.02 | 0.02 | 0.02 | 0.03 |
| " | 7 | 3 | " | 0.05 | 0.04 | 0.03 | 0.02 | 0.02 | 0.03 |
| " | 8 | 4 | " | 0.07 | 0.05 | 0.04 | 0.03 | 0.03 | 0.03 |
| Comparison | 9 | 1 | 102 | 0.03 | 0.03 | 0.02 | 0.02 | 0.02 | 0.03 |
| Invention | 10 | 2 | " | 0.04 | 0.04 | 0.03 | 0.02 | 0.03 | 0.03 |
| " | 11 | 3 | " | 0.05 | 0.04 | 0.04 | 0.03 | 0.03 | 0.03 |
| " | 12 | 4 | " | 0.07 | 0.06 | 0.04 | 0.04 | 0.03 | 0.03 |
| Comparison | 13 | 1 | 103 | 0.03 | 0.03 | 0.02 | 0.02 | 0.02 | 0.03 |
| Invention | 14 | 2 | " | 0.04 | 0.04 | 0.03 | 0.02 | 0.03 | 0.03 |
| " | 15 | 3 | " | 0.05 | 0.05 | 0.04 | 0.03 | 0.03 | 0.03 |
| " | 16 | 4 | " | 0.08 | 0.06 | 0.04 | 0.04 | 0.03 | 0.03 |
| Comparison | 17 | 1 | 104 | 0.03 | 0.03 | 0.02 | 0.02 | 0.03 | 0.03 |
| Invention | 18 | 2 | " | 0.04 | 0.04 | 0.04 | 0.02 | 0.03 | 0.03 |
| " | 19 | 3 | " | 0.05 | 0.05 | 0.04 | 0.03 | 0.03 | 0.03 |
| " | 20 | 4 | " | 0.08 | 0.06 | 0.05 | 0.04 | 0.03 | 0.04 |

From the results shown in Table 3, it can be seen that stable processing with remarkably reduced changes in gradation and fog density can be performed according to the present invention, even when the amount of replenisher is reduced.

EXAMPLE 2

The same procedure as described in Example 1 was conducted except that the processing steps and the compositions of processing solution used in Example 1 were changed to those shown below.

As a result, the stable performance with extremely small changes in gradation and fog density similar to those described in Example 1 was obtained.

TABLE 4

| Processing Step | Processing Time | Processing Temperature | Amount of (*1) Replenisher | Capacity of Tank |
|---|---|---|---|---|
| Color Development | 3 min 15 sec | 38.0° C. | Shown in Table 5 | 10 l |
| Bleaching | 1 min 00 sec | 38.0° C. | 530 ml | 4 l |
| Bleach-Fixing | 3 min 15 sec | 38.0° C. | 800 ml | 10 l |
| Washing with water (1) | 40 sec | 35.0° C. | (*2) | 4 l |
| Washing with Water (2) | 1 min 00 sec | 35.0° C. | 800 ml | 4 l |
| Stabilizing | 40 sec | 38.0° C. | 530 ml | 4 l |

TABLE 4-continued

| Processing Step | Processing Time | Processing Temperature | Amount of (*1) Replenisher | Capacity of Tank |
|---|---|---|---|---|
| Drying | 1 min 15 sec. | 55.0° C. | — | — |

(*1) Amount of replenisher per $m^2$ of the photographic light-sensitive material
(*2) Countercurrent system from Washing with Water (2) to Washing with Water (1)

TABLE 5

| Processing No. | Amount of Color Developing Replenisher (per $m^2$ of photographic light-sensitive material) | Concentration in Color Developing Replenisher: Developing Agent | Concentration in Color Developing Replenisher: Potassium Bromide |
|---|---|---|---|
| 1 | 1200 ml | 5.3 g/l | 0.7 g/l |
| 2 | 700 ml | 6.3 g/l | 0.4 g/l |
| 3 | 500 ml | 6.8 g/l | 0.1 g/l |
| 4 | 300 ml | 7.3 g/l | 0.0 g/l |

| | Tank Solution | Replenisher |
|---|---|---|
| Color Developing Solution: | | |
| Diethylenetriaminepentaacetic Acid | 1.0 g | 1.0 g |
| 1-Hydroxyethylidene-1,1-diphosphonic Acid | 3.0 g | 3.2 g |
| Sodium Sulfite | 4.0 g | 4.4 g |
| Potassium Carbonate | 30.0 g | 37.0 g |
| Potassium bromide | 1.4 g | 0.7 g |
| Potassium Iodide | 1.5 mg | — |
| Hydroxylamine Sulfate | 2.4 g | 2.8 g |
| 4-(N-Ethyl-N-β-hydroxyethylamino)-2-methylaniline Sulfate | 4.5 g | 5.5 g |
| Water to make | 1.0 l | 1.0 l |
| pH | 10.05 | 10.10 |
| Bleaching Solution: (both tank solution and replenisher) | | |
| Ammonium Fe (III) Ethylenediaminetetraacetate Dihydrate | 120.0 g | |
| Disodium Ethylenediaminetetraacetate | 10.0 g | |
| Ammonium Bromide | 100.0 g | |
| Ammonium Nitrate | 10.0 g | |
| Bleach Accelerating Agent: | 0.005 mol | |
| $[(H_3C)_2N-CH_2-CH_2-S]_2].2HCl$ | | |
| Aqueous Ammonia (27 wt %) | 15.0 ml | |
| Water to make | 1.0 l | |
| pH | 6.3 | |
| Bleach-Fixing Solution: (both tank solution and replenisher) | | |
| Ammonium Iron (III) Ethylenediaminetetraacetate Dihydrate | 50.0 g | |
| Disodium Ethylenediaminetetraacetate | 5.0 g | |
| Sodium sulfite | 12.0 g | |
| Aqueous Solution of Ammonium Thiosulfate (700 g/l aq. soln.) | 240.0 ml | |
| Aqueous Ammonia (27 wt %) | 6.0 ml | |
| Water to make | 1.0 l | |
| pH | 7.2 | |

Washing Water Solution: (both tank solution and replenisher)

City water was passed through a mixed bed type column filled with an H type strong acidic cation exchange resin (Amberlite IR-120B manufactured by Rohm & Haas Co.) and an OH type anion exchange resin (Amberlite IR-400 manufactured by Rohm & Haas Co.) to reduce both calcium ions and magnesium ions to a concentration not more than 3 mg per liter, and thus thus was added thereto sodium dichloroisocyanurate in an amount of 20 mg per liter and sodium sulfate in an amount of 1.5 g per liter.

The pH of the solution was in a range from 6.5 to 7.5.

| Stabilizing Solution: (both tank solution and replenisher) | |
|---|---|
| Formalin (37 wt %) | 2.0 ml |
| Polyoxyethylene-p-monomonyl Phenyl Ether (average degree of polymerization: 10) | 0.3 g |
| Disodium Ethylenediaminetetraacetate | 0.05 g |
| Water to make | 1 l |
| pH | 5.8 to 8.0 |

EXAMPLE 3

Sample 201:

On a cellulose triacetate film support provided with a subbing layer were coated layers having the compositions set forth below to prepare a multilayer color photographic light-sensitive material, which was designated Sample 201.

The coated amounts of the compositions are indicated in the same manner as shown in Example 1.

| | |
|---|---|
| First Layer: | |
| Antihalation Layer | |
| Black colloidal silver | 0.15 (as silver) |
| U-1 | 0.5 |
| U-1 | 0.2 |
| HBS-3 | 0.4 |
| Gelatin | 1.5 |
| Second Layer: | |
| Interlayer | |
| C-7 | 0.10 |
| C-3 | 0.11 |
| 2,5-Di-tert-octylhydroquinone | 0.05 |
| HBS-1 | 0.10 |
| Gelatin | 1.50 |
| Third Layer: | |
| First Red-Sensitive Emulsion Layer | |
| Mono-dispersed silver iodobromide emulsion (silver iodide content: 5 mol %, coefficient of variation on grain size: 17%, average grain size: 0.4 μm) | 0.9 (as silver) |
| C-12 | 0.35 |
| C-13 | 0.37 |
| C-3 | 0.12 |
| Compound (1) of the present invention | 0.052 |
| HBS-3 | 0.30 |
| Sensitizing Dye I | $4.5 \times 10^{-4}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| Gelatin | 1.50 |
| Fourth Layer: | |
| Second Red-Sensitive Emulsion Layer | |
| Mono-dispersed silver iodobromide emulsion (silver iodide content: 6 mol %, coefficient of variation on grain size: 16%, average grain size: 1.0 μm) | 1.0 (as silver) |
| Sensitizing Dye I | $3.0 \times 10^{-4}$ |
| Sensitizing Dye II | $1.0 \times 10^{-5}$ |
| Sensitizing Dye III | $1.5 \times 10^{-5}$ |
| Sensitizing Dye IV | $2.0 \times 10^{-5}$ |
| C-4 | 0.078 |
| C-3 | 0.045 |
| HBS-1 | 0.010 |
| Gelatin | 0.80 |
| Fifth Layer: | |
| Interlayer | |
| 2,5-Di-tert-octylhydroquinone | 0.12 |
| HBS-1 | 0.20 |
| Gelatin | 1.0 |

-continued

| | |
|---|---|
| Sixth Layer: | |
| First Green-Sensitive Emulsion Layer | |
| Silver iodobromide emulsion (silver iodide content: 6 mol %, coefficient of variation on grain size: 16%, average grain size: 0.4 μm) | 0.5 (as silver) |
| Sensitizing Dye V | $6.0 \times 10^{-5}$ |
| Sensitizing Dye VI | $2.0 \times 10^{-4}$ |
| Sensitizing Dye VII | $4.0 \times 10^{-4}$ |
| C-6 | 0.27 |
| C-1 | 0.072 |
| C-7 | 0.12 |
| C-8 | 0.010 |
| HBS-1 | 0.15 |
| Gelatin | 0.70 |
| Seventh Layer: | |
| Second Green-Sensitive Emulsion Layer | |
| Tabular silver iodobromide emulsion (silver iodide content: 5 mol %, Average aspect ratio: 7.5, average diameter based on projected area: 1.8 μm) | 0.80 (as silver) |
| Sensitizing Dye V | $4.0 \times 10^{-5}$ |
| Sensitizing Dye VI | $1.5 \times 10^{-4}$ |
| Sensitizing Dye VII | $3.0 \times 10^{-4}$ |
| C-6 | 0.071 |
| C-1 | 0.021 |
| C-7 | 0.016 |
| HBS-2 | 0.10 |
| Gelatin | 0.91 |
| Eighth Layer: | |
| Interlayer | |
| 2,5-Di-tert-octylhydroquinone | 0.05 |
| HBS-2 | 0.10 |
| Gelatin | 0.70 |
| Ninth Layer: | |
| Emulsion Layer | |
| Tabular silver iodobromide emulsion (silver iodide content: 4.0 mol %, Average aspect ratio: 7.0, average diameter based on projected areas: 1.6 μm) | 0.40 (as silver) |
| Sensitizing Dye X | $5.0 \times 10^{-5}$ |
| C-8 | 0.051 |
| C-14 | 0.095 |
| HBS-1 | 0.15 |
| HBS-2 | 0.15 |
| Gelatin | 0.60 |
| Tenth Layer: | |
| Yellow Filter Layer | |
| Yellow Colloidal silver | 0.83 (as silver) |
| 2,5-Di-tert-octylhydroquinone | 0.15 |
| HBS-1 | 0.20 |
| Gelatin | 0.80 |
| Eleventh Layer: | |
| First Blue-Sensitive Emulsion Layer | |
| Tabular silver iodobromide emulsion (silver iodide content: 4 mol %, Average aspect ratio: 7.3, average diameter based on projected areas: 1.3 μm) | 0.40 (as silver) |
| Sensitizing Dye VII | $7.0 \times 10^{-4}$ |
| C-9 | 1.10 |
| Compound (1) of the present invention | 0.050 |
| HBS-1 | 0.40 |
| Gelatin | 1.5 |
| Twelfth Layer: | |
| Second Blue-Sensitive Emulsion Layer | |
| Tubular silver iodobromide emulsion (silver iodide content: 5 mol %, Average aspect ratio: 7.2, average diameter based on projected area: 1.7 μm) | 0.6 (as silver) |
| Sensitizing Dye VII | $1.5 \times 10^{-4}$ |

-continued

| | |
|---|---|
| C-9 | 0.31 |
| HBS-1 | 0.12 |
| Gelatin | 0.88 |
| Thirteenth Layer: | |
| Interlayer | |
| U-1 | 0.12 |
| U-2 | 0.16 |
| HBS-3 | 0.12 |
| Gelatin | 0.75 |
| Fourteenth Layer: | |
| Protective Layer | |
| Silver iodobromide emulsion (silver iodide content: 4 mol %, coefficient of variation on grain size: 10%, average grain size: 0.08 μm) | 0.15 (as silver) |
| Polymethyl methacrylate particle (diameter: 1.5 μm) | 0.05 |
| Ethyl p-oxybenzoate | 0.008 |
| S-1 | 0.05 |
| S-2 | 0.15 |
| Gelatin | 0.80 |

A surface active agent and Gelatin Hardener H-1 were added to each of the layers in addition to the above described components.

Samples 202 to 204:

Samples 202 to 204 were prepared in the same manner as described for Sample 201 except using an equimolar amount of Compounds (3) and (5) according to the present invention and Comparative Compound C-10 in place of Compound (1) according to the present invention added to the third layer and the eleventh layer of Sample 201, respectively.

Samples 201 to 204 thus-prepared were each cut-through to 35 mm width, subjected to wedge exposure in an exposure amount of 20 CMS at the color temperature of 4800° K and then processed using an automatic developing machine according to the steps shown in Table 6 below.

Then, Sample 201 was cut-through to 35 mm width, exposed in a camera, and then continuously processed using an automatic developing machine according to Processing Nos. 5 to 9 as described in Table 7 below at rate of 10 meter per day until the accumulated amount of color developing replenisher reached 16 liters.

The changes in gradation and fog density were determined in the same manner as described in Example 1.

TABLE 6

| Processing Step | Processing Time | Processing Temperature | Amount of (*1) Replenisher | Capacity of Tank |
|---|---|---|---|---|
| Color Development | 2 min 15 sec | 40.0° C. | Shown in Table 7 | 8 l |
| Bleach-Fixing | 3 min 00 sec | 40.0° C. | 800 ml | 8 l |
| Washing with Water (1) | 20 sec | 35.0° C. | (*2) | 2 l |
| Washing with Water (2) | 20 sec | 35.0° C. | 800 ml | 2 l |
| Stabilizing | 20 sec | 38.0° C. | 530 ml | 2 l |
| Drying | 50 sec | 65.0° C. | — | — |

(*1) Amount of replenisher per $m^2$ of the photographic light-sensitive material (*2) Countercurrent system from Washing with Water (2) to Washing with Water (1)

TABLE 7

| Processing No. | Amount of Color Developing Replenisher (per $m^2$ of photographic light-sensitive material) | Concentration in Color Developing Replenisher: Developing Agent | Concentration in Color Developing Replenisher: Potassium Bromide | Color Developing Solution |
|---|---|---|---|---|
| 5 | 1200 ml | 6.6 g/l | 0.7 g/l | A |
| 6 | 400 ml | 7.5 g/l | 0.0 g/l | A |
| 7 | 400 ml | 7.5 g/l | 0.0 g/l | B |
| 8 | 400 ml | 7.5 g/l | 0.0 g/l | C |
| 9 | 400 ml | 7.5 g/l | 0.0 g/l | D |

The composition of each processing solution used is illustrated below.

| | Tank Solution | Replenisher |
|---|---|---|
| Color Developing Solution A: | | |
| Diethylenetriaminepentaacetic Acid | 0.005 mol | 0.0055 mol |
| 1-Hydroxyethylidene-1,1-diphosphonic Acid | 0.009 mol | 0.01 mol |
| Sodium Sulfite | 4.0 g | 5.5 g |
| Potassium Carbonate | 30.0 g | 37.0 g |
| Potassium Iodide | 1.5 mg | — |
| Potassium Bromide | 1.4 g | Shown in Table 7 |
| Hydroxylamine Sulfate | 2.4 g | 3.0 g |
| 4-(N-Ethyl-N-β-hydroxyethylamino)-2-methylaniline Sulfate | 5.0 g | Shown in Table 7 |
| Water to make | 1.0 l | 1.0 l |
| pH | 10.10 | 10.20 |
| Color Developing Solution B: | | |
| Diethylenetriaminepentaacetic Acid | 0.014 mol | 0.0155 mol |
| Sodium Sulfite | 4.0 g | 5.5 g |
| Potassium Carbonate | 30.0 g | 37.0 g |
| Potassium Iodide | 1.5 mg | — |
| Potassium Bromide | 1.4 g | Shown in Table 7 |
| Hydroxylamine Sulfate | 2.4 g | 3.0 g |
| 4-(N-Ethyl-N-β-hydroxyethylamino)-2-methylaniline Sulfate | 5.0 g | Shown in Table 7 |
| Water to make | 1.0 l | 1.0 l |
| pH | 10.10 | 10.20 |
| Color Developing Solution C: | | |
| 1-Hydroxyethylidene-1,1-diphosphonic Acid | 0.014 mol | 0.0155 mol |
| Sodium Sulfite | 4.0 g | 5.5 g |
| Potassium Carbonate | 30.0 g | 37.0 g |
| Potassium Iodide | 1.5 mg | — |
| Potassium Bromide | 1.4 g | Shown in Table 7 |
| Hydroxylamine Sulfate | 2.4 g | 3.0 g |
| 4-(N-Ethyl-N-β-hydroxyethylamino)-2-methylaniline Sulfate | 5.0 g | Shown in Table 7 |
| Water to make | 1.0 l | 1.0 l |
| pH | 10.10 | 10.20 |
| Color Developing Solution D: | | |
| Ethylenediaminetetraacetic acid | 0.014 mol | 0.0155 mol |
| Sodium Sulfite | 4.0 g | 5.5 g |
| Potassium Carbonate | 30.0 g | 37.0 g |
| Potassium Iodide | 1.5 mg | — |
| Potassium Bromide | 1.4 g | Shown in Table 7 |
| Hydroxylamine Sulfate | 2.4 g | 3.0 g |
| 4-(N-Ethyl-N- -hydroxyethylamino)-2-methylaniline Sulfate | 5.0 g | Shown in Table 7 |

-continued

| | Tank Solution | Replenisher |
|---|---|---|
| Water to make | 1.0 l | 1.0 l |
| pH | 10.10 | 10.20 |
| Bleach-Fixing Solution: (both tank solution and replenisher) | | |
| Ammonium Iron (III) Ethylenediaminetetraacetate Dihydrate | 90.0 g | |
| Disodium Ethylenediaminetetraacetate | 5.0 g | |
| Sodium Sulfite | 12.0 g | |
| Aqueous Solution of Ammonium Thiosulfate (70 g/l aq. soln.) | 260.0 ml | |
| Acetic Acid (98 wt %) | 5.0 ml | |
| Bleach Accelerating Agent: | 0.01 mol | |

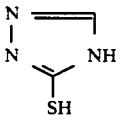

| | | |
|---|---|---|
| Water to make | 1.0 l | |
| pH | 6.0 | |

Washing Water Solution: (both tank solution and replenisher)

City water was passed through a mixed bed type column filled with an H type strong acidic cation exchange resin (Amberlite IR-120B manufactured by Rohm & Haas Co.) and an OH type anion exchange resin (Amberlite IR-400 manufactured by Rohm & Haas Co.) to reduce both calcium ions and magnesium ions to a concentration not more than 3 mg per liter, and thus was added thereto sodium dichloroisocyanurate in an amount of 20 mg per liter and sodium sulfate in an an amount of 0.15 g per liter.

The pH of the solution was in a range from 6.5 to 7.5.

| Stabilizing Solution: (both tank solution and replenisher) | |
|---|---|
| Formalin (37 wt %) | 2.0 ml |
| Polyoxyethylene-p-monononyl Phenyl Ether (average degree of polymerization: 10) | 0.3 g |
| Disodium Ethylenediaminetetraacetate | 0.05 g |
| Water to make | 1.0 l |
| pH | 5.8 to 8.0 |

The results are shown in Table 8 below.

TABLE 8

| | Experimental No. | Processing No. | Sample | Maximum Difference in Gradation Density: Y | M | C | Maximum Difference in Fog Density: Y | M | C |
|---|---|---|---|---|---|---|---|---|---|
| Comparison | 1 | 1 | 204 | 0.04 | 0.03 | 0.02 | 0.04 | 0.03 | 0.03 |
| " | 2 | 2 | " | 0.14 | 0.11 | 0.18 | 0.05 | 0.40 | 0.08 |
| " | 3 | 3 | " | 0.14 | 0.10 | 0.17 | 0.05 | 0.04 | 0.09 |
| " | 4 | 4 | " | 0.13 | 0.12 | 0.18 | 0.05 | 0.04 | 0.08 |
| " | 5 | 5 | " | 0.13 | 0.10 | 0.17 | 0.06 | 0.50 | 0.10 |

TABLE 8-continued

| | Experimental No. | Processing No. | Sample | Maximum Difference in Gradation Density Y | M | C | Maximum Difference in Fog Density Y | M | C |
|---|---|---|---|---|---|---|---|---|---|
| Comparison | 6 | 1 | 201 | 0.04 | 0.03 | 0.02 | 0.03 | 0.03 | 0.03 |
| This Invention | 7 | 2 | " | 0.07 | 0.05 | 0.03 | 0.04 | 0.03 | 0.03 |
| " | 8 | 3 | " | 0.08 | 0.05 | 0.05 | 0.05 | 0.04 | 0.03 |
| " | 9 | 4 | " | 0.08 | 0.05 | 0.06 | 0.05 | 0.04 | 0.04 |
| " | 10 | 5 | " | 0.09 | 0.07 | 0.09 | 0.06 | 0.04 | 0.05 |
| Comparison | 11 | 1 | 202 | 0.04 | 0.03 | 0.02 | 0.03 | 0.02 | 0.03 |
| This Invention | 12 | 2 | " | 0.08 | 0.05 | 0.03 | 0.04 | 0.03 | 0.03 |
| " | 13 | 3 | " | 0.08 | 0.05 | 0.04 | 0.05 | 0.04 | 0.04 |
| " | 14 | 4 | " | 0.08 | 0.06 | 0.05 | 0.05 | 0.04 | 0.04 |
| " | 15 | 5 | " | 0.09 | 0.07 | 0.08 | 0.06 | 0.05 | 0.05 |
| Comparison | 16 | 1 | 203 | 0.03 | 0.03 | 0.03 | 0.04 | 0.02 | 0.03 |
| This Invention | 17 | 2 | " | 0.08 | 0.04 | 0.03 | 0.04 | 0.03 | 0.03 |
| " | 18 | 3 | " | 0.08 | 0.05 | 0.04 | 0.04 | 0.03 | 0.03 |
| " | 19 | 4 | " | 0.08 | 0.06 | 0.04 | 0.04 | 0.04 | 0.03 |
| " | 20 | 5 | " | 0.08 | 0.07 | 0.06 | 0.04 | 0.04 | 0.05 |

As is apparent from the results shown in Table 8, the method according to the present invention exhibits the excellent effect even in the case of performing color development processing at high temperature and high speed. Also, it can be seen that the effect can be increased by using the compound represented by the formula (III) or (IV) in the color developing solution and remarkably increased in the case of employing both of these compounds.

EXAMPLE 4

The same procedure as in Example 1 was conducted in order to obtain Samples 402 to 404 and 409 to 413, except that Compound (1) used in the third layer, the fourth layer and the twelfth layer of Example 1 was changed to the compounds described in the following Table 9. In addition, Table 9 shows Samples 405 to 408 which are identical to Samples 101 to 104 of Example 1, and shows Sample 401 which is identical to Sample 105 of Example 1.

The obtained samples were processed in the same manner as in Processing No. 4 of Example 1 to obtain the maximum difference in gradation and the maximum difference in fog density.

The results are shown in Table 9 below.

TABLE 9

| Sample | Compound | Maximum Difference in Gradation Density Y | M | C | Maximum Difference in Fog Density Y | M | C | |
|---|---|---|---|---|---|---|---|---|
| 402 | (2) | 0.10 | 0.09 | 0.09 | 0.04 | 0.04 | 0.06 | Comparison |
| 403 | (28) | 0.10 | 0.10 | 0.11 | 0.04 | 0.04 | 0.07 | " |
| 404 | (A) | 0.09 | 0.09 | 0.10 | 0.04 | 0.04 | 0.06 | " |
| 405 | (1) | 0.07 | 0.05 | 0.04 | 0.03 | 0.03 | 0.03 | Invention |
| 406 | (3) | 0.07 | 0.06 | 0.04 | 0.04 | 0.03 | 0.03 | " |
| 407 | (5) | 0.08 | 0.06 | 0.04 | 0.04 | 0.03 | 0.03 | " |
| 408 | (10) | 0.08 | 0.06 | 0.05 | 0.04 | 0.03 | 0.04 | " |
| 401 | C-11 | 0.12 | 0.12 | 0.15 | 0.05 | 0.05 | 0.08 | Comparison |
| 409 | (36) | 0.08 | 0.05 | 0.05 | 0.04 | 0.03 | 0.04 | Invention |
| 410 | (4) | 0.07 | 0.06 | 0.05 | 0.04 | 0.04 | 0.04 | " |
| 411 | (13) | 0.08 | 0.06 | 0.06 | 0.04 | 0.03 | 0.04 | " |
| 412 | (26) | 0.07 | 0.05 | 0.05 | 0.03 | 0.04 | 0.04 | " |

TABLE 9-continued

| Sample | Compound | Maximum Difference in Gradation Density | | | Maximum Difference in Fog Density | | | |
|---|---|---|---|---|---|---|---|---|
| | | Y | M | C | Y | M | C | |
| 413 | (29) | 0.07 | 0.07 | 0.06 | 0.04 | 0.03 | 0.04 | " |

Compound (36):

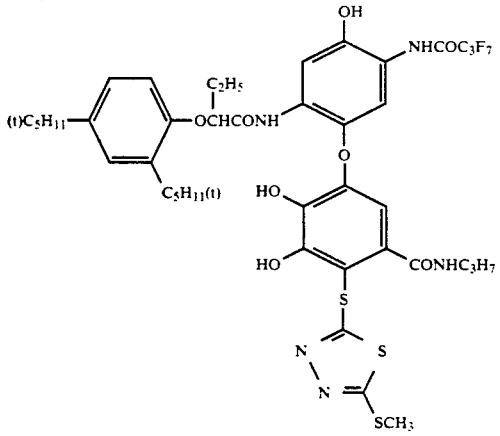

Compound A: Compound (2) of U.S. Pat. No. 4,618,571 to Ichijima et al

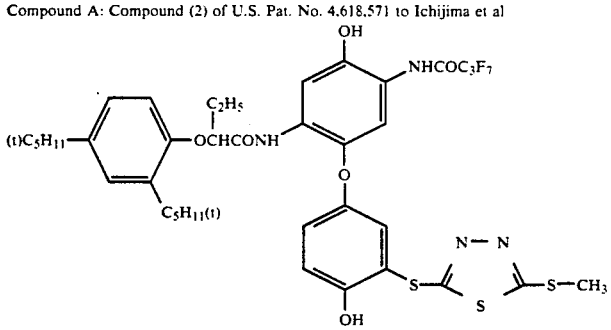

Compound C-11: Same as in Example 1.

As is apparent from the results (particularly the comparison between Samples 404 and 409) of Table 9, the remarkably reduced maximum difference in gradation and the remarkably reduced maximum difference in fog density can be obtained by using the compounds of the present invention even when the replenishment amount of the color developer is reduced.

As is apparent from the above results, the object of the present invention and the superiority of the present invention are achieved by providing the specific compounds of the present invention in the silver halide photographic material.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material comprising a support having thereon at least one of a light-sensitive silver halide emulsion layer and an adjacent layer thereof containing at least one compound represented by formula (V), wherein said silver halide color photographic material is subjected to a color-developing process with a color developing solution in which a replenisher is replenished in an amount of 700 ml or less per $m^2$ of the silver halide color photographic material:

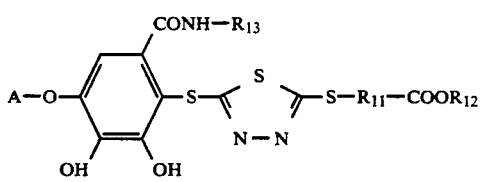

(V)

wherein A represents a coupler residue; $R_{11}$ represents a divalent aliphatic group having from 1 to 4 carbon atoms; and $R_{12}$ and $R_{13}$ each represents an aliphatic group having from 1 to 4 carbon atoms.

2. A method for processing a silver halide color photographic material as claimed in claim 1, wherein the coupler residue represented by A is a yellow coupler residue, a magenta coupler residue, a cyan coupler residue or a non-color forming coupler residue.

3. A method for processing a silver halide color photographic material as claimed in claim 1, wherein the amount of the at least one compound represented by the formula (V) added is in a range from $1\times10^{-6}$ to $1\times10^{-3}$ mol per $m^2$ of the silver halide color photographic material.

4. A method for processing a silver halide color photographic material as claimed in claim 1, wherein the amount of replenisher for a color developing solution is from 100 ml to 600 ml per $m^2$ of the silver halide color photographic material.

5. A method for processing a silver halide color photographic material as claimed in claim 1, wherein the color developing solution contains a color developing agent of N,N-dialkyl-p-phenylenediamine type.

6. A method for processing a silver halide color photographic material as claimed in claim 1, wherein a bromine ion concentration of the color developing solution is in a range from 0.005 to 0.02 mol per liter of the solution.

7. A method for processing a silver halide color photographic material as claimed in claim 1, wherein a bromide content in the replenisher for color developing solution is not more than 0.005 mol per liter.

8. A method for processing a silver halide color photographic material as claimed in claim 1, wherein the color developing solution contains a compound represented by the following formula (III) or (IV):

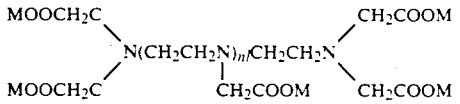

(III)

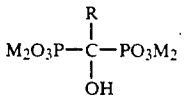

(IV)

wherein $n_1$ represents 1 or 2; R represents a lower alkyl group; M which may be the same or different, each represents a hydrogen atom, an alkali metal atom or an ammonium group.

* * * * *